US008952320B2

(12) United States Patent
Bateman et al.

(10) Patent No.: US 8,952,320 B2
(45) Date of Patent: Feb. 10, 2015

(54) MASS SPECTROMETER

(75) Inventors: Robert Harold Bateman, Cheshire (GB); Kevin Giles, Stockport (GB); Steven Derek Pringle, Darwen (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 2283 days.

(21) Appl. No.: 11/719,665

(22) PCT Filed: Nov. 18, 2005

(86) PCT No.: PCT/GB2005/004457
§ 371 (c)(1),
(2), (4) Date: Mar. 18, 2009

(87) PCT Pub. No.: WO2006/054101
PCT Pub. Date: May 26, 2006

(65) Prior Publication Data

US 2009/0194688 A1 Aug. 6, 2009

Related U.S. Application Data

(60) Provisional application No. 60/631,956, filed on Nov. 30, 2004.

(30) Foreign Application Priority Data

Nov. 18, 2004 (GB) ..... 0425426.4

(51) Int. Cl.
*H01J 49/26* (2006.01)
*H01J 49/42* (2006.01)

(52) U.S. Cl.
CPC ..... *H01J 49/4215* (2013.01); *H01J 49/428* (2013.01)
USPC ..... 250/281; 250/282

(58) Field of Classification Search
USPC ..... 250/281, 282, 290, 292, 293
See application file for complete search history.

(56) References Cited

U.S. PATENT DOCUMENTS

| | | | |
|---|---|---|---|
| 3,334,225 | A | 8/1967 | Langmuir |
| 5,187,365 | A | 2/1993 | Kelley |
| 5,466,931 | A | 11/1995 | Kelley |
| 5,598,001 | A | 1/1997 | Flory et al. |
| 5,672,870 | A | 9/1997 | Flory et al. |

(Continued)

OTHER PUBLICATIONS

Bruce et al. "Colored Noise Waveforms and Quadrupole Excitation for the Dynamic Range Expansion of FTICR Mass Spectrometry", Analytical Chemistry 1996, 68, pp. 534-541.*

*Primary Examiner* — Nicole Ippolito
(74) *Attorney, Agent, or Firm* — Diederiks & Whitelaw, PLC

(57) ABSTRACT

A mass spectrometer is disclosed comprising a quadrupole rod set ion guide or mass filter device (6). A broadband frequency signal (10) having one or more notches (11*a*, 11*b*, 11*c*) is applied to the rods of the quadrupole rod set (6). The notched broadband frequency signal (10) causes undesired ions to be resonantly ejected from the ion guide (6). The notched broadband frequency signal (10) has frequency components missing which correspond with the resonance frequency of ions which are desired to be onwardly transmitted. The ion guide or mass filter device (6) enables a plurality of desired ions having different mass to charge ratios to be simultaneously transmitted by the ion guide or mass filter device (6) whilst other ions are resonantly ejected from the ion guide or mass filter device (6).

57 Claims, 4 Drawing Sheets

(56) References Cited

U.S. PATENT DOCUMENTS

| | | | | |
|---|---|---|---|---|
| 5,703,358 | A | 12/1997 | Hoekman et al. | |
| 5,793,038 | A | 8/1998 | Buttrill, Jr. | |
| 6,093,929 | A | 7/2000 | Javahery et al. | |
| 6,107,623 | A | 8/2000 | Bateman et al. | |
| 6,114,691 | A | 9/2000 | Cousins | |
| 6,177,668 | B1 | 1/2001 | Hager | |
| 6,512,226 | B1 | 1/2003 | Loboda et al. | |
| 6,630,662 | B1 | 10/2003 | Loboda | |
| 6,847,037 | B2 | 1/2005 | Umemura | |
| 7,351,957 | B2 | 4/2008 | Bloomfield et al. | |
| 2003/0122071 | A1* | 7/2003 | Plomley et al. | 250/292 |
| 2005/0001163 | A1* | 1/2005 | Belov et al. | 250/290 |
| 2005/0061966 | A1* | 3/2005 | Ding et al. | 250/288 |
| 2007/0164208 | A1* | 7/2007 | Quarmby et al. | 250/282 |
| 2009/0101810 | A1* | 4/2009 | McLean et al. | 250/282 |

* cited by examiner

MASS SPECTROMETER

CROSS REFERENCE TO RELATED APPLICATIONS

This application is the National Stage of International Application No. PCT/GB2005/004457, filed on Nov. 18, 2005, which claims priority to and benefit of U.S. Provisional Patent Application Ser. No. 60/631,956, filed on Nov. 30, 2004, and priority to and benefit of United Kingdom Patent Application No. 0425426.4, filed Nov. 18, 2004. The entire contents of these applications are incorporated herein by reference.

BACKGROUND OF THE INVENTION

The present invention relates to an ion guide or mass filter device, a mass spectrometer, a method of guiding or mass filtering ions and a method of mass spectrometry. The preferred embodiment relates to a quadrupole rod set ion guide wherein a notched broadband frequency signal is applied to the rods of the quadrupole rod set ion guide. The notched broadband frequency signal preferably resonantly excites and radially ejects undesired background ions present in the ion guide whilst substantially unaffecting analyte or other ions of interest which are desired to be onwardly transmitted by the preferred ion guide or mass filter device.

A quadrupole rod set comprising four parallel rods is commonly used as an ion guide and as a mass filter or mass analyser. It is also known to use a quadrupole rod set as part of a linear ion trap wherein additional axial trapping potentials are applied in order to confine ions axially within the quadrupole rod set.

A quadrupole rod set comprising four parallel rods may be used as an ion guide to transmit ions without substantially mass filtering the ions by applying a two-phase RF signal or voltage to the rods. Adjacent rods are arranged to have opposite phases of the RF signal or voltage applied to them. The application of the RF signal or voltage to the rods results in a radial pseudo-potential well being generated which acts to confine ions radially within the quadrupole rod set. The four rods are maintained at the same DC potential or voltage. The quadrupole rod set ion guide may, in practice, exhibit a slight inherent low mass to charge ratio cut-off and the transmission efficiency of the ion guide may gradually reduce at higher mass to charge ratios. Nonetheless, to a first approximation at least the known quadrupole rod set ion guide may be considered as being arranged to transmit ions having a wide range of mass to charge ratios substantially simultaneously.

A quadrupole rod set may also be operated as a mass filter or mass analyser. According to this arrangement an RF signal or voltage is applied to the rods in a similar manner to a quadrupole rod set ion guide i.e. adjacent rods are supplied with opposite phases of a two-phase RF signal or voltage. However, instead of maintaining all the rods at the same DC voltage or potential, a DC component of voltage is applied to the rods such that adjacent rods have equal and opposite DC voltages applied to them. By applying an RF voltage to the rods and maintaining a DC potential difference between adjacent rods the quadrupole rod set can be arranged to act as a mass filter such that only ions having mass to charge ratios falling within well defined upper and lower mass to charge ratio cut-offs are transmitted by the mass filter. If the DC component is set to zero then the quadrupole rod set will then act as an ion guide in a non-resolving mode of operation wherein all ions received are substantially onwardly transmitted.

The mass to charge ratio transmission window of the mass filter can be narrowed to a point such that substantially only a single species of ion having a specific mass to charge ratio will be onwardly transmitted by the quadrupole rod set mass filter. All other ions will be substantially attenuated by the mass filter. Complete mass spectra can be obtained by scanning the RF and DC signals as a function of time so as to selectively sequentially transmit ions having different mass to charge ratios. The mass to charge ratio transmission window of the mass filter can therefore be progressively varied or increased. In this mode of operation the quadrupole rod set acts as a mass analyser.

A quadrupole rod set may also form part of a linear quadrupole ion trap. According to this arrangement an RF signal or voltage is applied to the rods in order to radially confine ions in a similar manner to a quadrupole rod set ion guide as described above. The rods are also all maintained at the same DC potential or voltage. In addition, potential barriers are maintained at the entrance and exit of the quadrupole rod set in order to prevent ions once they have been injected into the ion trap from exiting the quadrupole rod set ion trap in an axial direction. Ions are therefore effectively trapped within the quadrupole rod set ion trap. Once ions have been trapped within the ion trap, supplemental RF waveforms can then be applied to the electrodes of the ion trap in order to mass selectively eject certain ions either axially or radially from the ion trap. The frequency of the supplemental RF waveform which is applied to the electrodes can be scanned so as to mass selectively eject ions in sequence from the ion trap thereby enabling a mass spectrum to be produced. The resonance or first harmonic frequency $\omega_r$ for ion excitation in a confining RF field is given by:

$$\omega_r = \frac{\beta\Omega}{2}$$

wherein $\Omega$ is the angular frequency of the main confining RF voltage and $\beta$ is a parameter related to the mass to charge ratio of an ion through the Matthieu stability parameters a and q.

Conventional quadrupole rod set mass filters will now be considered in more detail. As discussed above, both RF and DC voltage components are applied to a conventional quadrupole rod set mass filter. The quadrupole rod set mass filter may be operated so as to have a relatively wide mass to charge ratio transmission window and hence can operate as a relatively low resolution mass filter. Alternatively, the quadrupole rod set mass filter may be operated so as to have a relatively narrow mass to charge ratio transmission window in which case the quadrupole rod set mass filter may be considered as operating as a relatively high resolution mass filter.

Operating the mass filter in a relatively low resolution mode will obviously provide better specificity than simply operating the quadrupole rod set as an ion guide in a non resolving mode. However, when the mass filter is operated in a relatively low resolution mode then it will transmit in parallel a plurality of ions having a continuum of mass to charge ratios between upper and lower mass to charge ratio cut-off values of the mass to charge ratio transmission window.

Operating the mass filter in a relatively high resolution mode will provide better specificity but disadvantageously only a single species of analyte ion of interest can then be transmitted by the mass filter at any one time. Accordingly, if other species of analyte ions of interest are also present, then the overall duty cycle will be reduced. In order to analyse other species of analyte ions it is necessary to scan the mass to charge ratio transmission window of the mass filter in order to selectively transmit different analyte ions of interest in a sequential manner.

It is desired to provide an improved ion guide or mass filter device.

SUMMARY OF THE INVENTION

According to a first aspect of the present invention there is provided an ion guide or mass filter device comprising:

a plurality of electrodes or rods;

an AC or RF voltage supply for supplying an AC or RF voltage to the plurality of electrodes or rods; and signal means arranged and adapted to supply a signal to the plurality of electrodes or rods in order to resonantly excite undesired ions within or from the ion guide or mass filter device.

It should be understood that conventional 2D or linear quadrupole rod set ion traps or conventional 3D quadrupole ion traps wherein ions are axially confined within the ion trap should not be construed as comprising an ion guide or mass filter device within the meaning of the present invention. It will also be appreciated that a conventional quadrupole rod set mass filter does not resonantly excite undesired ions within or from the mass filter.

The AC or RF voltage applied to the plurality of electrodes or rods in order to confine ions within the preferred ion guide or mass filter device can be considered to comprise a first AC or RF voltage. The signal applied to the plurality of electrodes or rods in order to resonantly excite undesired ions within or from the ion guide or mass filter device can be considered to comprise a second different AC or RF voltage.

The signal means is preferably arranged and adapted to radially eject undesired ions from the ion guide or mass filter device. The ion guide or mass filter device is preferably arranged and adapted to onwardly transmit ions without substantially confining or trapping ions axially within the ion guide or mass filter device. Analyte ions of interest are preferably onwardly transmitted by the ion guide or mass filter device without being substantially confined or trapped axially within the ion guide or mass filter device whereas other ions which are not of analytical interest are substantially attenuated by the ion guide or mass filter device.

The ion guide or mass filter device preferably comprises a quadrupole ion guide or mass filter device. The quadrupole ion guide or mass filter device preferably comprises a quadrupole rod set comprising four rods. Each rod of the quadrupole rod set preferably has a longitudinal axis and the longitudinal axes of each of the four rods are preferably substantially parallel to one another. The rods are also preferably equidistant to one another. The ion guide or mass filter device is preferably arranged to maintain a radial quadratic potential distribution or a radial linear electric field. The direction of the radial linear electric field oscillates or rotates with time such that there will be an instance in time when there is zero radial electric field.

The signal means is preferably arranged and adapted to supply a broadband frequency signal to the plurality of electrodes or rods comprising the preferred ion guide or mass filter device. The signal means is preferably arranged and adapted to supply a signal having one or more frequency components selected from one of more of the following ranges: (i) <1 kHz; (ii) 1-2 kHz; (iii) 2-3 kHz; (iv) 3-4 kHz; (v) 4-5 kHz; (vi) 5-6 kHz; (vii) 6-7 kHz; (viii) 7-8 kHz; (ix) 8-9 kHz; (x) 9-10 kHz; (xi) 10-11 kHz; (xii) 11-12 kHz; (xiii) 12-13 kHz; (xiv) 13-14 kHz; (xv) 14-15 kHz; (xvi) 15-16 kHz; (xvii) 16-17 kHz; (xviii) 17-18 kHz; (xix) 18-19 kHz; (xx) 19-20 kHz; (xxi) 20-21 kHz; (xxii) 21-22 kHz; (xxiii) 22-23 kHz; (xxiv) 23-24 kHz; (xxv) 24-25 kHz; (xxvi) 25-26 kHz; (Xavier) 26-27 kHz; (xxviii) 27-28 kHz; (xxix) 28-29 kHz; (xxvii) 29-30 kHz; and (xxxi) >30 kHz.

The signal means is preferably arranged and adapted to supply a signal having a dipolar and/or quadrupolar waveform. The signal means is preferably arranged and adapted to provide a signal having a plurality of frequency components which preferably correspond with the secular, resonance, first or fundamental harmonic frequency of a plurality of ions received in use by the preferred ion guide or mass filter device.

The signal means is preferably arranged and adapted to supply a signal having one or more frequency notches. The signal preferably comprises at least 1, 2, 3, 4, 5, 6, 7, 8, 9, 10, 11, 12, 13, 14, 15, 16, 17, 18, 19 or 20 frequency notches. The one or more frequency notches preferably correspond with the secular, resonance, first or fundamental harmonic frequencies of one or more ions which are desired to be onwardly transmitted by the preferred ion guide or mass filter device. The one or more frequency notches preferably correspond with the secular, resonance, first or fundamental harmonic frequencies of at least 1, 2, 3, 4, 5, 6, 7, 8, 9, 10, 11, 12, 13, 14, 15, 16, 17, 18, 19 or 20 different species of analyte ion of interest.

The signal means is preferably arranged and adapted to supply a signal to the plurality of electrodes or rods which preferably does not substantially cause analyte ions of interest to be resonantly excited and/or radially ejected from the preferred ion guide or mass filter device. According to the preferred embodiment at frequencies corresponding to the one or more frequency notches ions within the ion guide or mass filter device are preferably not substantially resonantly excited. According to a less preferred embodiment at frequencies corresponding to the one or more frequency notches ions within the ion guide or mass filter device may be slightly resonantly excited but are preferably not sufficiently resonantly excited such that ions are caused to be radially ejected from the preferred ion guide or mass filter device.

The signal means is preferably arranged and adapted to cause ions having a mass to charge ratio of M1 and M3 to be simultaneously onwardly transmitted by the preferred ion guide or mass filter device and to cause ions having a mass to charge ratio of M2 to be substantially attenuated by or resonantly ejected from the preferred ion guide or mass filter device, wherein M1<M2<M3.

The signal means is preferably arranged and adapted to cause ions having a mass to charge ratio of M1, M3 and M5 to be simultaneously onwardly transmitted by the preferred ion guide or mass filter device and to cause ions having a mass to charge ratio of M2 and M4 to be substantially attenuated by or resonantly ejected from the preferred ion guide or mass filter device, wherein M1<M2<M3<M4<M5.

The signal means is preferably arranged and adapted to cause ions having a mass to charge ratio of M1, M3, M5 and M7 to be simultaneously onwardly transmitted by the preferred ion guide or mass filter device and to cause ions having a mass to charge ratio of M2, M4 and M6 to be substantially attenuated by or resonantly ejected from the preferred ion guide or mass filter device, wherein M1<M2<M3<M4<M5<M6<M7.

The signal means is preferably arranged and adapted to cause ions having a mass to charge ratio of M1, M3, M5, M7 and M9 to be simultaneously onwardly transmitted by the preferred ion guide or mass filter device and to cause ions having a mass to charge ratio of M2, M4, M6 and MB to be substantially attenuated by or resonantly ejected from the preferred ion guide or mass filter device, wherein M1<M2<M3<M4<M5<M6<M7<M8<M9.

The signal means is preferably arranged and adapted to cause the preferred ion guide or mass filter device to have one or a plurality of discrete or separate simultaneous mass to charge ratio transmission windows such that an ion having a mass to charge ratio falling within a mass to charge ratio transmission window will be onwardly transmitted by the preferred ion guide or mass filter device. The signal means is preferably arranged and adapted to cause the ion guide or mass filter device to have one or a plurality of discrete or separate simultaneous mass to charge ratio transmission windows such that an ion having a mass to charge ratio falling outside of a mass to charge ratio transmission window will be substantially attenuated by and/or resonantly ejected from the preferred ion guide or mass filter device.

The signal means is preferably arranged and adapted to cause the ion guide or mass filter device to have at least 1, 2, 3, 4, 5, 6, 7, 8, 9, 10, 11, 12, 13, 14, 15, 16, 17, 18, 19 or 20 discrete or separate simultaneous mass to charge ratio transmission windows. The discrete or separate simultaneous mass to charge ratio transmission windows are preferably substantially non-overlapping and/or non-continuous. Ions having mass to charge ratios intermediate two neighbouring mass to charge ratio transmission windows are preferably substantially attenuated and/or resonantly ejected from the preferred ion guide or mass filter device.

According to an embodiment the centre or middle and/or width of one or more of the mass to charge ratio transmission windows preferably remains substantially constant with time or over a time period selected from the group consisting of: (i) 0-1 ms; (ii) 1-2 ms; (iii) 2-3 ms; (iv) 3-4 ms; (v) 4-5 ms; (vi) 5-6 ms; (vii) 6-7 ms; (viii) 7-8 ms; (ix) 8-9 ms; (x) 9-10 ms; (xi) 10-11 ms; (xii) 11-12 ms; (xiii) 12-13 ms; (xiv) 13-14 ms; (xv) 14-15 ms; (xvi) 15-16 ms; (xvii) 16-17 ms; (xviii) 17-18 ms; (xix) 18-19 ms; (xx) 19-20 ms; (xxi) 20-21 ms; (xxii) 21-22 ms; (xxiii) 22-23 ms; (xxiv) 23-24 ms; (xxv) 24-25 ms; (xxvi) 25-26 ms; (xxvii) 26-27 ms; (xxviii) 27-28 ms; (xxix) 28-29 ms; (xxx) 29-30 ms; and (xxxi) >30 ms.

According to another embodiment the centre or middle and/or width of one or more of the mass to charge ratio transmission windows substantially preferably varies and/or increases and/or decreases with time or over a time period selected from the group consisting of: (i) 0-1 ms; (ii) 1-2 ms; (iii) 2-3 ms; (iv) 3-4 ms; (v) 4-5 ms; (vi) 5-6 ms; (vii) 6-7 ms; (viii) 7-8 ms; (ix) 8-9 ms; (x) 9-10 ms; (xi) 10-11 ms; (xii) 11-12 ms; (xiii) 12-13 ms; (xiv) 13-14 ms; (xv) 14-15 ms; (xvi) 15-16 ms; (xvii) 16-17 ms; (xviii) 17-18 ms; (xix) 18-19 ms; (xx) 19-20 ms; (xxi) 20-21 ms; (xxii) 21-22 ms; (xxiii) 22-23 ms; (xxiv) 23-24 ms; (xxv) 24-25 ms; (xxvi) 25-26 ms; (xxvii) 26-27 ms; (xxviii) 27-28 ms; (xxix) 28-29 ms; (xxx) 29-30 ms; and (xxxi) >30 ms. The centre and/or width of the one or more mass to charge ratio transmission windows may vary in a substantially progressive, non-progressive, linear, non-linear, quadratic, smooth, stepped, regular, random or quasi-random manner.

According to an embodiment the signal means is preferably arranged and adapted to apply the signal to opposed or non-adjacent electrodes or rods of the preferred ion guide or mass filter device.

The ion guide or mass filter device preferably has an ion entrance region and an ion exit region and wherein in a mode of operation x % of the ions received by the preferred ion guide or mass filter device at the ion entrance region are preferably transmitted to the ion exit region, wherein x is selected from the group consisting of: (i) <1; (ii) 1-5; (iii) 5-10; (iv) 10-15; (v) 15-20; (vi) 20-25; (vii) 25-30; (viii) 30-35; (ix) 35-40; (x) 40-45; (xi) 45-50; (xii) 50-55; (xiii) 55-60; (xiv) 60-65; (xv) 65-70; (xvi) 70-75; (xvii) 75-80; (xviii) 80-85; (xix) 85-90; (xx) 90-95; (xxi) 95-99.99; and (xxii) <100.

The ion guide or mass filter device preferably has an ion entrance region and an ion exit region and wherein in a mode of operation y % of the ions received by the preferred ion guide or mass filter device at the ion entrance region are preferably attenuated and/or radially ejected from the preferred ion guide or mass filter device before reaching the ion exit region, wherein y is selected from the group consisting of: (i) <1; (ii) 1-5; (iii) 5-10; (iv) 10-15; (v) 15-20; (vi) 20-25; (vii) 25-30; (viii) 30-35; (ix) 35-40; (x) 40-45; (xi) 45-50; (xii) 50-55; (xiii) 55-60; (xiv) 60-65; (xv) 65-70; (xvi) 70-75; (xvii) 75-80; (xviii) 80-85; (xix) 85-90; (xx) 90-95; (xxi) 95-99.99; and (xxii) <100.

The ion guide or mass filter device is preferably arranged and adapted to simultaneously transmit a plurality of different desired ions having a non-continuous range of mass to charge ratios.

The AC or RF voltage supply preferably comprises a two phase supply and wherein opposite phases of an AC or RF voltage are arranged to be applied to adjacent electrodes or rods of the preferred ion guide or mass filtering device. The AC or RF voltage supply is preferably arranged and adapted to supply an AC or RF voltage to the plurality of electrodes or rods having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-1000 V peak to peak; (xii) 1-2 kV peak to peak; (xiii) 2-3 kV peak to peak; (xiv) 3-4 kV peak to peak; (xv) 4-5 kV peak to peak; (xvi) 5-6 kV peak to peak; (xvii) 6-7 kV peak to peak; (xviii) 7-8 kV peak to peak; (xix) 8-9 kV peak to peak; (xx) 9-10 kV peak to peak; and (xxi) >10 kV peak to peak.

The AC or RF voltage supply is preferably arranged and adapted to supply an AC or RF voltage to the plurality of electrodes or rods having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

According to an embodiment in a first mode of operation substantially all of the electrodes or rods are maintained at substantially the same DC potential or voltage. According to this embodiment the ion guide or mass filter device is preferably operated in a substantially non-resolving or ion guiding mode of operation.

According to an embodiment in a second mode of operation adjacent electrodes or rods are preferably maintained at substantially different DC potentials or voltages. According to this embodiment a DC potential or voltage difference is preferably maintained between adjacent electrodes or rods, wherein the DC potential or voltage difference is preferably selected from the group consisting of: (i) <1 V; (ii) 1-2 V; (iii) 2-3 V; (iv) 3-4 V; (v) 4-5 V; (vi) 5-6 V; (vii) 6-7 V; (viii) 7-8 V; (ix) 8-9 V; (x) 9-10 V; (xi) 10-20 V; (xii) 20-30 V; (xiii) 30-40 V; (xiv) 40-50 V; (xv) 50-60 V; (xvi) 60-70 V; (xvii) 70-80 V; (xviii) 80-90 V; (xix) 90-100 V; and (xx) >100 V.

In the second mode of operation opposed electrodes or rods are preferably maintained at substantially the same DC potential or voltage.

According to an embodiment in a mode of operation the ion guide or mass filter device may be operated in a resolving or mass filtering mode of operation. According to an embodiment in a mode of operation the ion guide or mass filter device may have one or more mass to charge ratio transmission windows, one or more of said mass to charge ratio transmission windows having a width of z mass units, wherein z falls within a range selected from the group consisting of: (i) <1; (ii) 1-2; (iii) 2-3; (iv) 3-0.4; (v) 4-5; (vi) 5-6; (vii) 6-7; (viii) 7-8; (ix) 8-9; (x) 9-10; (xi) 10-15; (xii) 15-20; (xiii) 20-25; (xiv) 25-30; (xv) 30-35; (xvi) 35-40; (xvii) 40-45; (xviii) 45-50; (xix) 50-60; (xx) 60-70; (xxi) 70-80; (xxii) 80-90; (xxiii) 90-100; (xxiv) 100-120; (xxv) 120-140; (xxvi) 140-160; (xxvii) 160-180; (xxviii) 180-200; (xxix) 200-250; (xxx) 250-300; (xxxi) 300-350; (xxxii) 350-400; (xxxiii) 400-450; (xxxiv) 450-500; and (xxxv) >500.

In a mode of operation a combination of DC and/or AC or RF voltages are preferably applied to the plurality of electrodes or rods such that the preferred ion guide or mass filter device is arranged to operate as a low pass mass filter.

According to an embodiment when the ion guide or mass filter device is arranged to operate as a low pass mass filter ions having a mass to charge ratio greater than a high mass to charge ratio cut-off value are substantially attenuated by the preferred ion guide or mass filter device, and wherein the high mass to charge ratio cut-off value is preferably selected from the group consisting of: (i) <100; (ii) 100-200; (iii) 200-300; (iv) 300-400; (v) 400-500; (vi) 500-600; (vii) 600-700; (viii) 700-800; (ix) 800-900; (x) 900-1000; (xi) 1000-1100; (xii) 1100-1200; (xiii) 1200-1300; (xiv) 1300-1400; (xv) 1400-1500; (xvi) 1500-1600; (xvii) 1600-1700; (xviii) 1700-1800; (xix) 1800-1900; (xx) 1900-2000; and (xxi) >2000.

In a mode of operation a combination of DC and/or AC or RF voltages are preferably applied to the plurality of electrodes or rods such that the preferred ion guide or mass filter device is arranged to operate as a band pass mass filter.

When the ion guide or mass filter device is arranged to operate as a band pass mass filter ions having a mass to charge ratio greater than a high mass to charge ratio cut-off value are preferably substantially attenuated by the ion guide or mass filter device, and wherein the high mass to charge ratio cut-off value is preferably selected from the group consisting of: (i) <100; (ii) 100-200; (iii) 200-300; (iv) 300-400; (v) 400-500; (vi) 500-600; (vii) 600-700; (viii) 700-800; (ix) 800-900; (x) 900-1000; (xi) 1000-1100; (xii) 1100-1200; (xiii) 1200-1300; (xiv) 1300-1400; (xv) 1400-1500; (xvi) 1500-1600; (xvii) 1600-1700; (xviii) 1700-1800; (xix) 1800-1900; (xx) 1900-2000; and (xxi) >2000. When the ion guide or mass filter device is arranged to operate as a band pass mass filter ions having a mass to charge ratio lower than a low mass to charge ratio cut-off value are preferably substantially attenuated by the ion guide or mass filter device, and wherein the low mass to charge ratio cut-off value is preferably selected from the group consisting of: (i) <100; (ii) 100-200; (iii) 200-300; (iv) 300-400; (v) 400-500; (vi) 500-600; (vii) 600-700; (viii) 700-800; (ix) 800-900; (x) 900-1000; (xi) 1000-1100; (xii) 1100-1200; (xiii) 1200-1300; (xiv) 1300-1400; (xv) 1400-1500; (xvi) 1500-1600; (xvii) 1600-1700; (xviii) 1700-1800; (xix) 1800-1900; (xx)-1900-2000; and (xxi) >2000.

According to an embodiment in a mode of operation a combination of DC and/or AC or RF voltages are preferably applied to the plurality of electrodes or rods such that the ion guide or mass filter device is arranged to operate as a high pass mass filter. When the ion guide or mass filter device is arranged to operate as a high pass mass filter ions having a mass to charge ratio lower than a low mass to charge ratio cut-off value are preferably substantially attenuated by the ion guide or mass filter device, and wherein the low mass to charge ratio cut-off value is preferably selected from the group consisting of: (i) <100; (ii) 100-200; (iii) 200-300; (iv) 300-400; (v) 400-500; (vi) 500-600; (vii) 600-700; (viii) 700-800; (ix) 800-900; (x) 900-1000; (xi) 1000-1100; (xii) 1100-1200; (xiii) 1200-1300; (Xiv) 1300-1400; (xv) 1400-1500; (xvi) 1500-1600; (xvii) 1600-1700; (xviii) 1700-1800; (xix) 1800-1900; (xx) 1900-2000; and (xxi) >2000.

According to an embodiment in a mode of operation the ion guide or mass filter device may be maintained at a pressure: (i) $<10^{-3}$ mbar; (ii) $<10^{-4}$ mbar; (iii) $<10^{-5}$ mbar; (iv) $<10^{-6}$ mbar; (v) $<10^{-7}$ mbar; (vi) $10^{-3}$ to $10^{-4}$ mbar; (vii) $10^{-4}$ to $10^{-5}$ mbar; and (viii) $>10^{-3}$ mbar. The preferred ion guide or mass filter device is preferably operated at such pressures (i.e. $<10^{-3}$ mbar) when the preferred ion guide or mass filter device is being operated in a mass or mass to charge ratio resolving mode i.e. as a mass filter.

According to an embodiment in a mode of operation the ion guide or mass filter device may be maintained at a pressure: (i) >100 mbar; (ii) <100 mbar; (iii) <10 mbar; (iv) <1 mbar; (v) $<10^{-1}$ mbar; (vi) $<10^{-2}$ mbar; (vii) $<10^{-3}$ mbar; (viii) $<10^{-4}$ mbar; (ix) $<10^{-5}$ mbar; (x) $<10^{-6}$ mbar; (xi) $<10^{-7}$ mbar; (xii) 10-100 mbar; (xiii) 1-10 mbar; (xiv) 0.1-1 mbar; (xv) $10^{-2}$ to $10^{-1}$ mbar; (xvi) $10^{-3}$ to $10^{-2}$ mbar; (xvii) $10^{-4}$ to $10^{-3}$ mbar; and (xviii) $10^{-5}$ to $10^{-4}$ mbar. The preferred ion guide or mass filter device may be operated at relatively high pressures (i.e. up to 100 mbar) when the preferred ion guide or mass filter device is being operated in a non-resolving mode i.e. as an ion guide without filtering ions according to their mass or mass to charge ratio.

According to another aspect of the present invention there is provided a mass spectrometer comprising an ion guide or mass filter device as described above.

The mass spectrometer preferably further comprises a collision, fragmentation or reaction device arranged upstream and/or downstream of the preferred ion guide or mass filter device. The collision, fragmentation or reaction device preferably comprises: (i) a multipole rod set or a segmented multipole rod set; (ii) an ion tunnel or ion funnel; or (iii) a stack or array of planar, plate or mesh electrodes.

The multipole rod set preferably comprises a quadrupole rod set, a hexapole rod set, an octapole rod set or a rod set comprising more than eight rods.

The ion tunnel or ion funnel preferably comprises a plurality of electrodes or at least 2, 5, 10, 20, 30, 40, 50, 60, 70, 80, 90 or 100 electrodes having apertures through which ions are transmitted in use and wherein at least 5%, 10%, 15%, 20%, 25%, 30%, 35%, 40%, 45%, 50%, 55%, 60%, 65%, 70%, 75%, 80%, 85%, 90%, 95% or 100% of the electrodes have apertures which are of substantially the same size or area or which have apertures which become progressively larger and/or smaller in size or in area. At least 5%, 10%, 15%, 20%, 25%, 30%, 35%, 40%, 45%, 50%, 55%, 60%, 65%, 70%, 75%, 80%, 85%, 90%, 95% or 100% of the electrodes preferably have internal diameters or dimensions selected from the group consisting of: (i) ≤1.0 mm; (ii) ≤2.0 mm; (iii) ≤3.0 mm; (iv) ≤4.0 mm; (v) ≤5.0 mm; (vi) ≤6.0 mm; (vii) ≤7.0 mm; (viii) ≤8.0 mm; (ix) ≤9.0 mm; (x) ≤10.0 mm; and (xi) >10.0 mm.

The stack or array of planar, plate or mesh electrodes preferably comprises a plurality or at least 2, 3, 4, 5, 6, 7, 8, 9, 10, 11, 12, 13, 14, 15, 16, 17, 18, 19 or 20 planar, plate or mesh electrodes, wherein at least 5%, 10%, 15%, 20%, 25%, 30%, 35%, 40%, 45%, 50%, 55%, 60%, 65%, 70%, 75%, 80%, 85%, 90%, 95% or 100% of the planar, plate or mesh electrodes are preferably arranged generally in the plane in which ions travel in use. AC or RF voltage means are preferably provided for supplying the plurality of planar, plate or mesh electrodes with an AC or RF voltage and wherein adjacent planar, plate or mesh electrodes are preferably supplied with opposite phases of the AC or RF voltage.

According to an embodiment the collision, fragmentation or reaction device preferably comprises a plurality of axial segments or at least 5, 10, 15, 20, 25, 30, 35, 40, 45, 50, 55, 60, 65, 70, 75, 80, 85, 90, 95 or 100 axial segments.

The mass spectrometer preferably further comprises DC voltage means for maintaining a substantially constant DC voltage gradient along at least 5%, 10%, 15%, 20%, 25%, 30%, 35%, 40%, 45%, 50%, 55%, 60%, 65%, 70%, 75%, 80%, 85%, 90%, 95% or 100% of the axial length of the collision, fragmentation or reaction device.

The mass spectrometer preferably further comprises transient DC voltage means arranged and adapted to apply one or more transient DC voltages or potentials or one or more transient DC voltage or potential waveforms to electrodes forming the collision, fragmentation or reaction device in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the collision, fragmentation or reaction device.

The mass spectrometer preferably further comprises AC or RF voltage means arranged and adapted to apply two or more phase-shifted AC or RF voltages to electrodes forming the collision, fragmentation or reaction device in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the collision, fragmentation or reaction cell or device.

The collision, fragmentation or reaction device preferably further comprises AC or RF voltage means arranged and adapted to apply an AC or RF voltage to at least 5%, 10%, 15%, 20%, 25%, 30%, 35%, 40%, 45%, 50%, 55%, 60%, 65%, 70%, 75%, 80%, 85%, 90%, 95% or 100% of the plurality of electrodes of the collision, fragmentation or reaction device in order to confine ions radially within the collision, fragmentation or reaction device. The AC or RF voltage means is preferably arranged and adapted to supply an AC or RF voltage to the plurality of electrodes of the collision, fragmentation or reaction device having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak. The AC or RF voltage means is preferably arranged and adapted to supply an AC or RF voltage to the plurality of electrodes of the collision, fragmentation or reaction device having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

According to the preferred embodiment the collision, fragmentation or reaction cell or device is preferably arranged to fragment ions by Collisional Induced Dissociation ("CID").

According to another embodiment the mass spectrometer may further comprise a collision, fragmentation or reaction device selected from the group consisting of: (i) a Surface Induced Dissociation ("SID") fragmentation device; (ii) an Electron Transfer Dissociation fragmentation device; (iii) an Electron Capture Dissociation fragmentation device; (iv) an Electron Collision or Impact Dissociation fragmentation device; (v) a Photo Induced Dissociation ("PID") fragmentation device; (vi) a Laser Induced Dissociation fragmentation device; (vii) an infrared radiation induced dissociation device; (viii) an ultraviolet radiation induced dissociation device; (ix) a nozzle-skimmer interface fragmentation device; (x) an in-source fragmentation device; (xi) an ion-source Collision Induced Dissociation fragmentation device; (xii) a thermal or temperature source fragmentation device; (xiii) an electric field induced fragmentation device; (xiv) a magnetic field induced fragmentation device; (xv) an enzyme digestion or enzyme degradation fragmentation device; (xvi) an ion-ion reaction fragmentation device; (xvii) an ion-molecule reaction fragmentation device; (xviii) an ion-atom reaction fragmentation device; (xix) an ion-metastable ion reaction fragmentation device; (xx) an ion-metastable molecule reaction fragmentation device; (xxi) an ion-metastable atom reaction fragmentation device; (xxii) an ion-ion reaction device for reacting ions to form adduct or product ions; (xxiii) an ion-molecule reaction device for reacting ions to form adduct or product ions; (xxiv) an ion-atom reaction device for reacting ions to form adduct or product ions; (xxv) an ion-metastable ion reaction device for reacting ions to form adduct or product ions; (xxvi) an ion-metastable molecule reaction device for reacting ions to form adduct or product ions; and (xxvii) an ion-metastable atom reaction device for reacting ions to form adduct or product ions.

According to an embodiment the mass spectrometer further comprises an ion mobility spectrometer or separator arranged upstream and/or downstream of the preferred ion guide or mass filter device. The ion mobility spectrometer or separator preferably comprises a gas phase electrophoresis device.

According to an embodiment the ion mobility spectrometer or separator comprises: (i) a drift tube; (ii) a multipole rod set or a segmented multipole rod set; (iii) an ion tunnel or ion funnel; or (iv) a stack or array of planar, plate or mesh electrodes.

The drift tube preferably comprises one or more electrodes and means for maintaining an axial DC voltage gradient or a substantially constant or linear axial DC voltage gradient along at least 5%, 10%, 15%, 20%, 25%, 30%, 35%, 40%, 45%, 50%, 55%, 60%, 65%, 70%, 75%, 80%, 85%, 90%, 95% or 100% of the axial length of the drift tube.

The multipole rod set preferably comprises a quadrupole rod set, a hexapole rod set, an octapole rod set or a rod set comprising more than eight rods.

The ion tunnel or ion funnel comprises a plurality of electrodes or at least 2, 5, 10, 20, 30, 40, 50, 60, 70, 80, 90 or 100 electrodes having apertures through which ions are transmitted in use and wherein at least 5%, 10%, 15%, 20%, 25%, 30%, 35%, 40%, 45%, 50%, 55%, 60%, 65%, 70%, 75%, 80%, 85%, 90%, 95% or 100% of the electrodes have apertures which are of substantially the same size or area or which have apertures which become progressively larger and/or smaller in size or in area. At least 5%, 10%, 15%, 20%, 25%, 30%, 35%, 40%, 45%, 50%, 55%, 60%, 65%, 70%, 75%, 80%, 85%, 90%, 95% or 100% of the electrodes preferably have internal diameters or dimensions selected from the group consisting of: (i) ≤1.0 mm; (ii) ≤2.0 mm; (iii) ≤3.0 mm;

(iv) ≤4.0 mm; (v) ≤5.0 mm; (vi) ≤6.0 mm; (vii) ≤7.0 mm; (viii) ≤8.0 mm; (ix) ≤9.0 mm; (x) ≤10.0 mm; and (xi) >10.0 mm.

The stack or array of planar, plate or mesh electrodes preferably comprises a plurality or at least 2, 3, 4, 5, 6, 7, 8, 9, 10, 11, 12, 13, 14, 15, 16, 17, 18, 19 or 20 planar, plate or mesh electrodes arranged generally in the plane in which ions travel in use. At least some or at least 5%, 10%, 15%, 20%, 25%, 30%, 35%, 40%, 45%, 50%, 55%, 60%, 65%, 70%, 75%, 80%, 85%, 90%, 95% or 100% of the planar, plate or mesh electrodes are preferably supplied with an AC or RF voltage and wherein adjacent planar, plate or mesh electrodes are supplied with opposite phases of the AC or RF voltage.

According to the preferred embodiment the ion mobility spectrometer or separator preferably comprises a plurality of axial segments or at least 5, 10, 15, 20, 25, 30, 35, 40, 45, 50, 55, 60, 65, 70, 75, 80, 85, 90, 95 or 100 axial segments.

The mass spectrometer preferably further comprises DC voltage means for maintaining a substantially constant DC voltage gradient along at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion mobility spectrometer or separator in order to urge at least some ions along at least 5%, 10%, 15%, 20%, 25%, 30%, 0.35%, 40%, 45%, 50%, 55%, 60%, 65%, 70%, 75%, 80%, 85%, 90%, 95% or 100% of the axial length of the ion mobility spectrometer or separator.

The mass spectrometer preferably further comprises transient DC voltage means arranged and adapted to apply one or more transient DC voltages or potentials or one or more transient DC voltage or potential waveforms to electrodes forming the ion mobility spectrometer or separator to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion mobility spectrometer or separator.

The mass spectrometer preferably further comprises AC or RF voltage means arranged and adapted to apply two or more phase-shifted AC or RF voltages to electrodes forming the ion mobility spectrometer or separator to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion mobility spectrometer or separator.

The ion mobility spectrometer or separator preferably has an axial length selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; (xi) 200-220 mm; (xii) 220-240 mm; (xiii) 240-260 mm; (xiv) 260-280 mm; (xv) 280-300 mm; (xvi) >300 mm.

The ion mobility spectrometer or separator preferably further comprises AC or RF voltage means arranged and adapted to apply an AC or RF voltage to at least 5%, 10%, 15%, 20%, 25%, 30%, 35%, 40%, 45%, 50%, 55%, 60%, 65%, 70%, 75%, 80%, 85%, 90%, 95% or 100% of the plurality of electrodes of the ion mobility spectrometer or separator in order to confine ions radially within the ion mobility spectrometer or separator. The AC or RF voltage means is preferably arranged and adapted to supply an AC or RF voltage to the plurality of electrodes of the ion mobility spectrometer or separator having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak. The AC or RF voltage means is preferably arranged and adapted to supply an AC or RF voltage to the plurality of electrodes of the ion mobility spectrometer or separator having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5. MHz; (xxii) 8.5-9.0 MHz; (xxiii) 9.0-9.5 MHz; (xxiv) 9.5-10.0 MHz; and (xxv) >10.0 MHz.

According to an embodiment singly charged ions having a mass to charge ratio in the range of 1-100, 100-200, 200-300, 300-400, 400-500, 500-600, 600-700, 700-800, 800-900 or 900-1000 have a drift or transit time through the ion mobility spectrometer or separator in the range: (i) 0-1 ms; (ii) 1-2 ms; (iii) 2-3 ms; (iv) 3-4 ms; (v) 4-5 ms; (vi) 5-6 ms; (vii) 6-7 ms; (viii) 7-8 ms; (ix) 8-9 ms; (x) 9-10 ms; (xi) 10-11 ms; (xii) 11-12 ms; (xiii) 12-13 ms; (xiv) 13-14 ms; (xv) 14-15 ms; (xvi) 15-16 ms; (xvii) 16-17 ms; (xviii) 17-18 ms; (xix) 18-19 ms; (xx) 19-20 ms; (xxi) 20-21 ms; (xxii) 21-22 ms; (xxiii) 22-23 ms; (xxiv) 23-24 ms; (xxv) 24-25 ms; (xxvi) 25-26 ms; (xxvii) 26-27 ms; (xxviii) 27-28 ms; (xxix) 28-29 ms; (xxx) 29-30 ms; and (xxxi) >30 ms.

According to an embodiment the mass spectrometer preferably further comprises means arranged and adapted to maintain at least a portion of the ion mobility spectrometer or separator at a pressure selected from the group consisting of: (i) >0.001 mbar; (ii) >0.01 mbar; (iii) >0.1 mbar; (iv) >1 mbar; (v) >10 mbar; (vi) >100 mbar; (vii) 0.001-100 mbar; (viii) 0.01-10 mbar; and (ix) 0.1-1 mbar.

A first gas is preferably introduced into the ion mobility spectrometer or separator, the first gas preferably being selected from or at least partially comprising a gas selected from the group consisting of: (i) nitrogen; (ii) argon; (iii) helium; (iv) methane; (v) neon; (vi) xenon; and (vii) air.

The mass spectrometer preferably further comprises a housing for the ion mobility spectrometer or separator, the housing preferably forming a substantially gas tight enclosure apart from an ion entrance aperture, an ion exit aperture and a port for introducing a gas into the housing.

Ions are preferably pulsed into the ion mobility spectrometer or separator once every 0-5 ms, 5-10 ms, 10-15 ms, 15-20 ms, 20-25 ms, 25-30 ms, 30-35 ms, 35-40 ms, 40-45 ms, 45-50 ms or >50 ms.

According to an embodiment the mass spectrometer preferably further comprises a drift region, drift tube or field free region arranged upstream and/or downstream of the preferred ion guide or mass filter device. The drift region is preferably arranged and adapted to temporally separate ions according to their mass to charge ratio.

According to another embodiment the mass spectrometer preferably further comprises an ion trap or ion trapping region arranged upstream and/or downstream of the preferred ion guide or mass filter device. Ions are preferably arranged in a mode of operation to be mass selectively and/or resonantly ejected from the ion trap or ion trapping region. Alternatively, ions may in a mode of operation be arranged to be non-mass selectively and/or resonantly ejected from the ion trap or ion trapping region.

The ion trap may comprise a quadrupole ion trap, a 2D or linear quadrupole ion trap or a Paul or 3D quadrupole ion trap.

The mass spectrometer preferably further comprises an ion source. The ion source is preferably selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source.

The ion source may comprise a pulsed or continuous ion source.

The mass spectrometer preferably further comprises a mass analyser. The mass analyser is preferably selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; and (xi) a Fourier Transform mass analyser.

According to another aspect of the present invention there is provided a method of guiding or mass filtering ions comprising:

providing an ion guide or a mass filter device comprising a plurality of electrodes or rods;

supplying an AC or RF voltage to the plurality of electrodes or rods; and supplying a signal to the plurality of electrodes or rods in order to resonantly excite undesired ions within or from the ion guide or mass filter device.

According to another aspect of the present invention there is provided an ion guide comprising:

a plurality of electrodes; and voltage means for applying one or more voltages to the plurality of electrodes such that ions having a mass to charge ratio of M1 and ions having a mass to charge ratio of M3 are simultaneously transmitted by the ion guide whereas ions having a mass to charge ratio of M2 are not substantially transmitted by the ion guide, wherein M1<M2<M3.

According to another aspect of the present invention there is provided an ion guide comprising:

a plurality of electrodes; and voltage means for applying one or more voltages to the plurality of electrodes such that ions having a mass to charge ratio of M1, M3 and M5 are simultaneously transmitted by the ion guide whereas ions having a mass to charge ratio of M2 and M4 are not substantially transmitted by the ion guide, wherein M1<M2<M3<M4<M5.

According to another aspect of the present invention there is provided an ion guide comprising:

one or more electrodes;

means arranged and adapted to cause ions having mass to charge ratios within a first range to be substantially retained within the ion guide and ions having mass to charge ratios within a second different range to be substantially retained within the ion guide whilst ions having mass to charge ratios intermediate the first and second ranges are caused to be ejected from the ion guide.

According to another aspect of the present invention there is provided a quadrupole rod set ion guide arranged and adapted to have a plurality of separate or discrete non-overlapping and simultaneous mass to charge ratio transmission windows and wherein ions having mass to charge ratios outside one of the plurality of mass to charge ratio transmission windows are substantially attenuated by the ion guide.

According to another aspect of the present invention there is provided a quadrupole rod set ion guide arranged and adapted to onwardly transmit analyte ions of interest without substantially trapping ions axially within the ion guide, wherein in use a broadband frequency signal is applied to the ion guide in order to resonantly eject ions which are not desired to be onwardly transmitted by the ion guide.

According to another aspect of the present invention there is provided a quadrupole rod set ion guide having a first mass to charge ratio transmission window and a second different simultaneous mass to charge ratio transmission window, wherein the first mass to charge ratio transmission window does not overlap with the second mass to charge ratio transmission window.

According to a preferred embodiment the quadrupole rod set ion guide comprises a third different simultaneous mass to charge ratio transmission window, wherein the first, second and third mass to charge ratio transmission windows do not overlap with one another. The quadrupole rod set ion guide may preferably comprise a fourth different simultaneous mass to charge ratio transmission window, wherein the first, second, third and fourth mass to charge ratio transmission windows do not overlap with one another. Ions having mass to charge ratios intermediate the first, second, third and fourth mass to charge ratio transmission windows are preferably substantially attenuated.

According to another aspect of the present invention there is provided a method of mass spectrometry comprising:

providing a quadrupole rod set ion guide;

generating a broadband frequency signal;

removing frequency components from the broadband frequency signal in order to provide a notched broadband frequency signal having one or more frequency notches;

applying the notched broadband frequency signal having one or more frequency notches to the quadrupole rod set ion guide; and passing a beam of ions into the quadrupole rod set ion guide and allowing a sub-set of the beam of ions to emerge from the quadrupole rod set ion guide without axially confining ions within the quadrupole rod set.

According to a preferred embodiment of the present invention a quadrupole rod set ion guide is provided wherein a notched broadband frequency signal is applied, in use, to the rods of the quadrupole rod set. The applied notched broadband frequency signal preferably has the effect of attenuating ions which are not desired to be onwardly transmitted by the preferred ion guide but preferably does not substantially affect the onward transmission of ions which are desired to be onwardly transmitted.

The preferred embodiment preferably relates to a quadrupole rod set ion guide which facilitates the continuous transmission of a plurality of different species of ions wherein the ions which are transmitted preferably do not have a single continuum of mass to charge ratios. According to the preferred embodiment the preferred ion guide or mass filter device is preferably able to simultaneously transmit in parallel a plurality of different discrete ion species whilst substantially attenuating other ions having mass to charge ratios intermediate the mass to charge ratios of the ions which are onwardly transmitted. This is in contrast to a low resolution conventional quadrupole rod set mass filter which is only able to transmit ions having mass to charge ratios which form a continuum within a single mass to charge ratio transmission window. The ion beam which preferably exits a preferred ion guide or mass filter device preferably has an ion composition or mass to charge ratio profile which is preferably a subset of the composition or mass to charge ratio profile of the ion beam which is preferably initially received by the preferred ion guide or mass filter device.

According to a preferred embodiment a two-phase AC or RF voltage is preferably applied to the rods of the quadrupole rod set ion guide in order to confine ions radially within the ion guide. In addition a notched broadband frequency signal is preferably applied to two opposed rods of the quadrupole rod set. The notched broadband frequency signal preferably causes unwanted ions to be resonantly excited and radially ejected from the preferred ion guide or mass filter device whilst analyte ions of interest are preferably substantially unaffected by the application of the notched broadband frequency signal to the quadrupole rod set. The broadband frequency signal which is preferably applied to the preferred ion guide or mass filter device preferably has one or more frequency components missing which preferably correspond with the resonance, secular, fundamental or first harmonic frequencies of analyte or other ions of interest which are desired to be onwardly transmitted by the preferred ion guide or mass filter device.

In a preferred mode of operation the preferred ion guide or mass filter device preferably onwardly transmits a substantially continuous flow of specific ions of interest whilst substantially attenuating all other ions. The ions which are preferably onwardly transmitted by the preferred ion guide or mass filter device preferably have a plurality of different mass to charge ratios and the ions are preferably transmitted in parallel for subsequent analysis. Ions having intermediate mass to charge ratios are preferably attenuated. By way of example, a beam of ions having a continuum of mass to charge ratios in the range of 200-500 may be considered as being received by the preferred ion guide or mass filter device. If only ions having specific mass to charge ratios of 250, 350 and 450 are desired to be simultaneously onwardly transmitted, then a notched broadband frequency signal may be applied to the preferred ion guide or mass filter device which has frequencies present which will have the effect of resonantly exciting and radially ejecting all the ions received apart from those ions having mass to charge ratios of 250, 350 and 450. The notched broadband frequency signal will therefore preferably have frequency components missing which correspond with the resonance or first harmonic frequency of ions having mass to charge ratios of 250, 350 and 450. Accordingly, ions having mass to charge ratios of 250, 350 and 450 are not resonantly excited by the applied broadband frequency signal and hence are not radially ejected from the preferred ion guide or mass filter device. Consequently, ions having specific mass to charge ratios of 250, 350 and 450 are onwardly transmitted by the preferred ion guide or mass filter device whilst all other ions will be resonantly excited and radially ejected from the ion guide and hence will be substantially attenuated or otherwise lost to the system.

BRIEF DESCRIPTION OF THE DRAWINGS

Various embodiments of the present invention together with an arrangement given for illustrative purposes only will now be described, by way of example only, and with reference to the accompanying drawings in which.

DETAILED DESCRIPTION OF THE PREFERRED EMBODIMENTS

Figure 1:
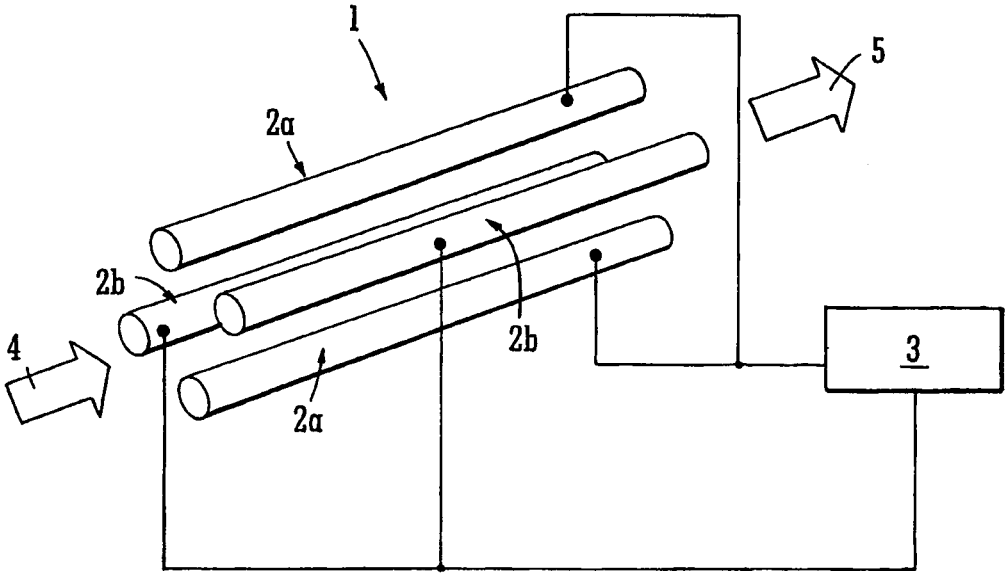
FIG. 1 PRIOR ART
FIG. 1 shows a conventional quadrupole rod set ion guide.

A conventional quadrupole rod set ion guide 1 is shown in FIG. 1. The quadrupole rod set comprises four parallel rods 2*a*,2*b*. All four rods 2*a*,2*b* are maintained at substantially the same DC voltage or potential. A two phase RF voltage supply 3 is connected to the rods 2*a*,2*b* such that adjacent rods have opposite phases of an RF voltage applied to them whilst diametrically opposed rods 2*a*;2*b* have the same phase RF voltage applied to them. The RF voltage applied to the rods 2*a*,2*b* creates a radial pseudo-potential well which acts to confine ions radially within the ion guide 1. Ions are not confined axially within the ion guide 1.

The conventional quadrupole rod set ion guide 1 transmits ions simultaneously through the ion guide 1 without substantially mass filtering the ions at least to first approximation. Therefore, to a first approximation at least, substantially all the ions 4 received at the entrance to the ion guide 1 will be onwardly transmitted by the ion guide 1. As a result the composition of the beam of ions 5 which emerges from the exit of the ion guide 1 will be substantially similar to the composition of the beam of ions 4 which was initially received at the entrance to the ion guide 1.

The quadrupole rod set 1 may alternatively be operated as a mass filter or mass analyser by maintaining a DC potential difference between adjacent rods. When operated as a mass filter or mass analyser only ions having mass to charge ratios which fall within a certain mass to charge ratio transmission window will have stable trajectories through the mass filter. Accordingly, only those ions having mass to charge ratios which fall within the mass to charge ratio transmission window will be onwardly transmitted by the mass filter. All other ions will have unstable trajectories through the mass filter or mass analyser and hence will become lost to the system.

Figure 2:
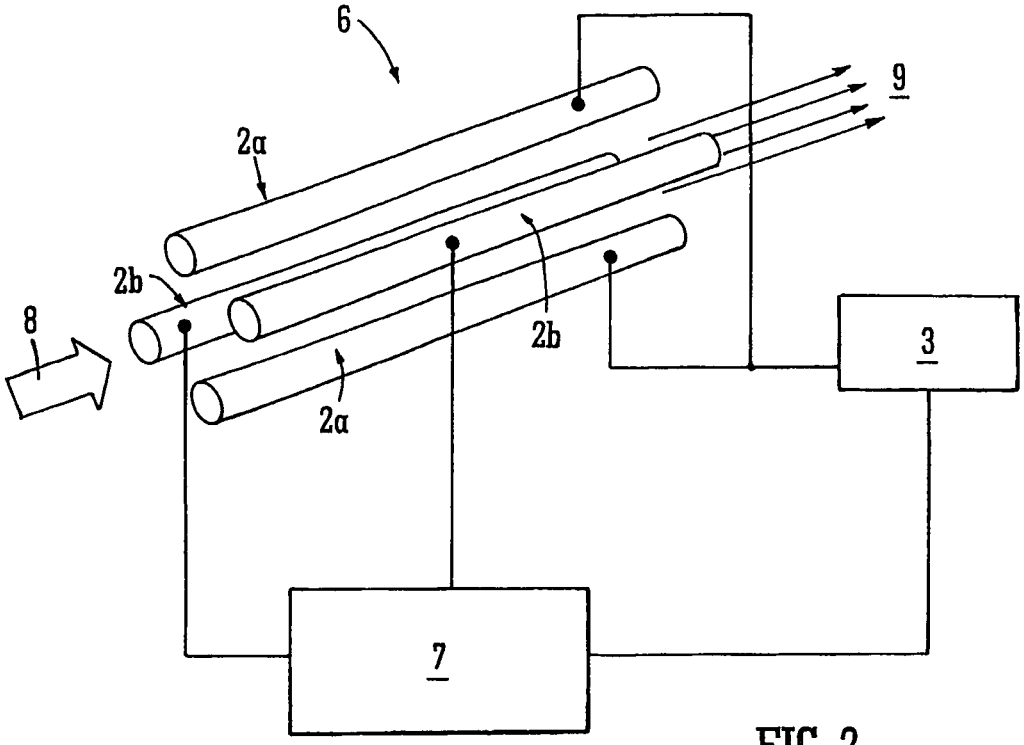
FIG. 2 shows an ion guide or mass filter device according to a preferred embodiment of the present invention wherein a notched broadband frequency signal is applied to two opposed rods in order to resonantly excite and radially eject undesired ions.

An ion guide or mass filter device 6 according to a preferred embodiment of the present invention is shown in FIG. 2. The ion guide or mass filter device 6 preferably comprises a quadrupole rod set comprising four parallel rods 2*a*,2*b*. According to the preferred embodiment the rods 2*a*,2*b* are connected to a two phase AC or RF voltage supply 3. Adjacent rods are preferably arranged so as to have opposite phases of an AC or RF voltage applied to them and diametrically opposed rods 2*a*;2*b* are preferably arranged so as to have the same phase of an AC or RF voltage applied to them. The AC or RF voltage applied to the rods 2*a*,2*b* preferably creates a radial pseudo-potential well which preferably acts to radially confine ions within the preferred ion guide or mass filter device 6.

According to the preferred embodiment a notched broadband frequency signal 7 is preferably applied to an opposed pair of rods 2*a*;2*b*. The notched broadband frequency signal 7 preferably comprises a supplemental dipolar waveform. The application of a notched broadband frequency signal 7 to an opposed pair of rods 2*a*,2*b* preferably causes a majority of ions which are not desired to be onwardly transmitted by the preferred ion guide or mass filter device 6 to be resonantly excited and radially ejected from the preferred ion guide or mass filter device 6. The strength of the resonant excitation and radial movement of the undesired ions is preferably sufficient so as to overcome the effect of the radial pseudo-potential well generated by the applied AC or RF voltage which otherwise seeks to radially confine ions within the preferred ion guide or mass filter device 6.

The notches provided in the otherwise broadband frequency signal 7 are preferably arranged such that there are some frequencies or frequency components which are preferably absent or otherwise missing from the broadband frequency signal 7 which is preferably applied to the rods 2*a*;2*b*. Ions having resonance or first harmonic frequencies which substantially correspond with the absent or missing frequencies in the applied broadband frequency signal 7 will preferably not therefore be resonantly excited by the applied broadband frequency signal 7. Accordingly, these ions will not be radially ejected from the preferred ion guide or mass filter device 6. Consequently, these ions will therefore be substantially unaffected by the application of the broadband frequency signal 7 to the rods 2*a*,2*b*. As a result ions which are desired to be onwardly transmitted by the preferred ion guide or mass filter device 6 will be retained within the preferred ion guide or mass filter device 6 and will preferably be onwardly transmitted by the preferred ion guide or mass filter device 6.

According to a less preferred embodiment the notched broadband frequency signal 7 which is preferably applied to an opposed pair of rods 2*a*;2*b* may include relatively low amplitude frequency components which may resonantly excite analyte ions of interest but only to a relatively small or minor degree. The amplitude of these frequency components is preferably kept relatively low and hence the ions of interest are not sufficiently resonantly excited such that they are able to overcome the radially confining action of the radial pseudo-potential well resulting from the applied AC or RF voltage.

The broadband dipolar waveform 7 which is preferably applied to the rods 2*a*,2*b* preferably causes some or a majority of ions to be resonantly excited and radially ejected from the preferred ion guide or mass filter device 6 whilst substantially not affecting one or more analyte ions of interest having certain specific mass to charge ratios which are intended or are otherwise desired to be radially retained within and onwardly transmitted by the preferred ion guide or mass filter device 6. Ions which are desired to be transmitted by the preferred ion guide or mass filter device 6 and which are substantially unaffected by the application of the broadband frequency signal 7 are therefore arranged to be simultaneously transmitted in parallel through the preferred ion guide or mass filter device 6. The ions 9 which are onwardly simultaneously transmitted preferably constitute a subset or reduced set of the ions 8 received at the entrance to the preferred ion guide or mass filter device 6.

The ions 9 which are preferably simultaneously onwardly transmitted by the preferred ion guide or mass filter device 6 preferably have a range of different and distinct mass to charge ratios. The preferred ion guide or mass filter device 6 therefore preferably transmits ions having a mass to charge ratio profile which is preferably different to the mass to charge ratio profile of a conventional quadrupole rod set ion guide or a conventional quadrupole rod set mass filter operating in either a low or high resolution mode.

The dipolar broadband waveform 7 which is preferably applied to a pair of rods 2*a*;2*b* of the preferred ion guide or mass filter device 6 is preferably created or generated by initially providing a broadband frequency signal and then preferably removing certain specific frequency components from the broadband frequency signal. Those frequencies or frequency components which are preferably removed from the broadband frequency signal preferably correspond with the resonance or first harmonic frequencies of ions of interest which are desired to be onwardly transmitted by the preferred ion guide or mass filter device 6.

Figure 3:
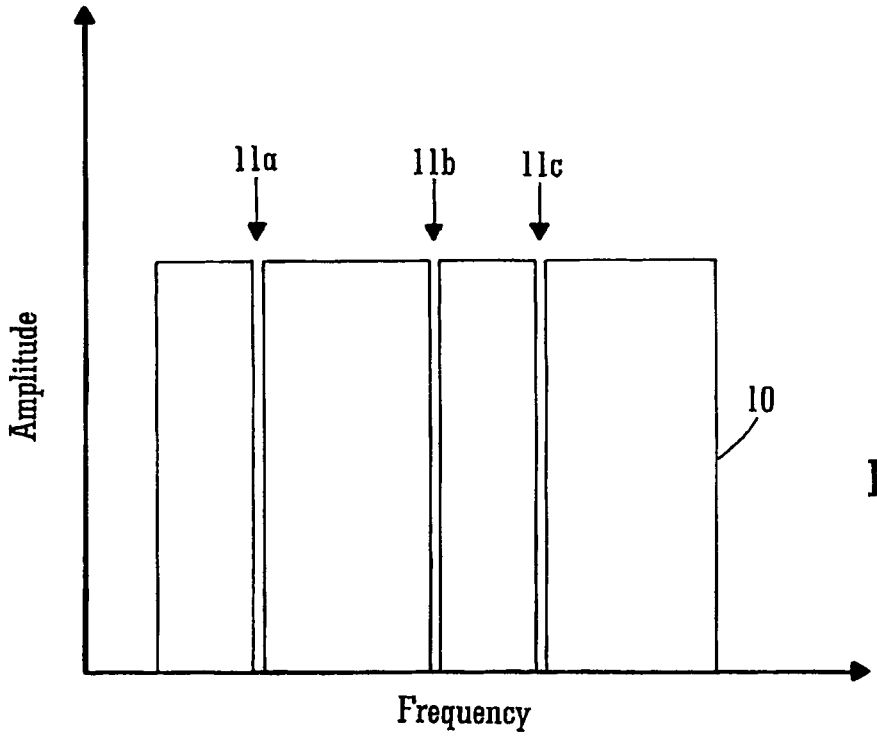
FIG. 3 shows a schematic representation of a notched broadband frequency signal which may be applied to two opposed rods of a quadrupole rod set according to a preferred embodiment.

An example of a notched broadband frequency signal 10 which may preferably be applied to a quadrupole rod set ion guide 6 according to an embodiment of the present invention is shown in FIG. 3. The notched broadband frequency signal 10 is shown having a plurality of frequency notches 11*a*,11*b*, 11*c*. One or more frequency notches 11*a*,11*b*,11*c* are preferably provided in the broadband frequency signal 10 with missing frequencies preferably corresponding with or to the resonant or first harmonic frequency of certain species of analyte ions which are desired to be onwardly transmitted by the preferred ion guide or mass filter device 6. The range of the broadband frequency signal 10 is preferably sufficiently wide such that all the undesired ions present in an ion beam 8 received by the preferred ion guide or mass filter device 6 will preferably be resonantly excited and radially ejected from the preferred ion guide or mass filter 6 whilst analyte ions of interest are preferably substantially retained. Accordingly, all the ions 8 received into the preferred ion guide or mass filter device 6 will preferably be resonantly excited and radially ejected from the preferred ion guide or mass filter device 6 except for those ions having resonance frequencies which correspond with one of the frequency notches 11*a*;11*b*;11*c* present in the broadband frequency signal 10 or a frequency component missing from the broadband frequency signal.

Ions 8 are preferably arranged to enter the preferred ion guide or mass filter device 6 in a substantially axial direction or manner although other embodiments are contemplated wherein ions may be arranged to enter the preferred ion guide or mass filter device 6 in a non-axial, radial or other manner. It is also contemplated that ions may be created within the preferred ion guide or mass filter device 6.

Ions having resonant or fundamental harmonic frequencies which correspond with a frequency component of the applied broadband frequency signal 10 are preferably resonantly excited and are preferably radially ejected from the preferred ion guide or mass filter device 6. However, ions having resonant or fundamental harmonic frequencies which preferably coincide with or which preferably substantially correspond with one of the frequency notches 11*a*,11*b*,11*c* in the broadband frequency signal 10 are preferably not resonantly excited and are preferably not substantially radially ejected from the preferred ion guide or mass filter device 6. These ions therefore preferably remain within the preferred ion guide or mass filter device 6. The subset of ions 9 which are preferably retained within and which are preferably transmitted through the preferred ion guide or mass filter device 6 then preferably exit the preferred ion guide or mass filter device 6 in a substantially axial direction. These ions may then be detected by an ion detector or may be transmitted to another device or component of a mass spectrometer. According to a less preferred embodiment desired ions may be caused to be ejected from the preferred ion guide or mass filter device 6 in a radial or other direction.

Figure 4A:
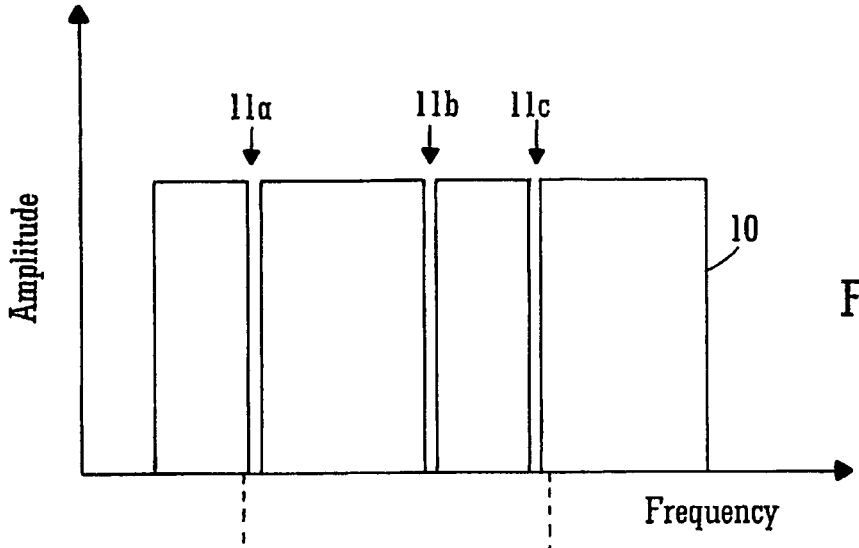
FIG. 4A illustrates an embodiment wherein a broadband frequency signal having a relatively wide range of frequencies is applied to a quadrupole rod set ion guide and FIG. 4B illustrates an alternative embodiment wherein a broadband frequency signal having a narrower range of frequencies is applied to a quadrupole rod set mass filter operating as a low resolution mass filter.

The quadrupole rod set ion guide or mass filter device 6 may be operated in a non-resolving or ion guiding mode wherein all the rods are preferably maintained at substantially the same DC voltage or potential. FIG. 4A shows how according to this embodiment the frequency range of the applied broadband frequency signal 10 preferably extends above and below the resonance frequency of the lowest and highest mass to charge ratio ions expected to be received into the preferred ion guide or mass filter device 6. The notched broadband frequency signal 10 may therefore be arranged so as to potentially effectively resonantly excite and hence radially eject all the ions received into the preferred ion guide or mass filter device 6 apart from those ions having a secular or resonance frequency which corresponds with a frequency notch 11*a*; 11*b*;11*c* in the notched broadband frequency signal 10 or with a frequency component missing from the broadband frequency signal 10.

Figure 4B:
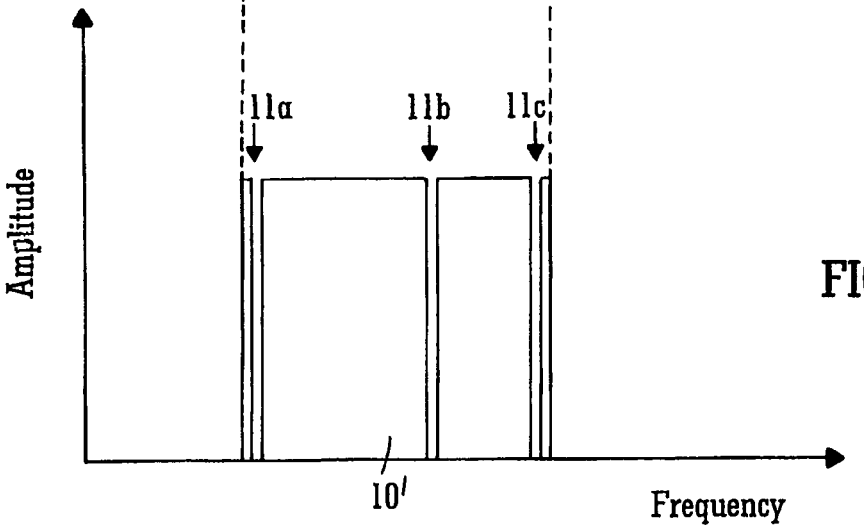

According to an alternative embodiment as will be described in more detail with reference to FIG. 4B, the quadrupole rod set ion guide or mass filter device 6 may be operated in a relatively low resolution mass filtering mode of operation. According to this mode of operation a combination of DC and RF voltages are preferably applied to the rods 2*a*,2*b* of the preferred ion guide or mass filter device 6 such that adjacent rods are preferably maintained at substantially equal and opposite DC potentials or voltages. The quadrupole rod set 6 therefore preferably operates as a low resolution mass filter. Accordingly, only ions having certain mass to charge ratios within a mass to charge ratio transmission window bounded by an upper and a lower mass to charge ratio cut-off will be transmitted by the quadrupole rod set 6. This is irrespective of the effect of applying a notched broadband frequency signal to the quadrupole rod set 6. This embodiment enables a notched broadband frequency signal 10' having a reduced frequency content or a reduced range of frequencies to be preferably applied to the quadrupole rod set 6 in order to remove unwanted ions whilst not substantially affecting the retention and onward transmission of analyte ions of interest.

According to this embodiment ions can be considered as being subjected to two different effects. Firstly, all ions having mass to charge ratios falling outside of the mass to charge ratio transmission window of the quadrupole rod set mass filter will be attenuated since these ions will have unstable trajectories through the quadrupole rod set and will become lost to the system. Secondly, those ions which do have mass to charge ratios falling within the transmission window of the quadrupole mass filter are additionally subjected to the effect of a notched broadband frequency signal 10' which preferably has a frequency range which preferably generally or substantially corresponds with the mass to charge ratio transmission window of the quadrupole rod set mass filter. Only those ions having resonance or fundamental harmonic frequencies which correspond with a frequency notch 11*a*,11*b*,11*c* in the broadband frequency signal 10' will be onwardly transmitted. Others ions even though they may have mass to charge ratios which fall within the mass to charge ration transmission window of the quadrupole rod set mass filter will be resonantly excited and radially ejected from the quadrupole rod set.

Embodiments are contemplated wherein when the quadrupole rod set is being operated as a low resolution mass filter the one or more mass to charge ratio transmissions windows created by the application of the notched broadband frequency signal may partially extend beyond, overlap or be contained wholly within the single mass to charge ratio transmission window of the quadrupole rod set mass filter.

The preferred ion guide or mass filter device 6 preferably acts as a simultaneous multiple ion transmission ion guide or mass filter device 6 which preferably simultaneously transmits a subset 9 of the ions 8 received from, for example, an ion source. The ions may then be transmitted for further analysis or for ion detection.

Figure 5:
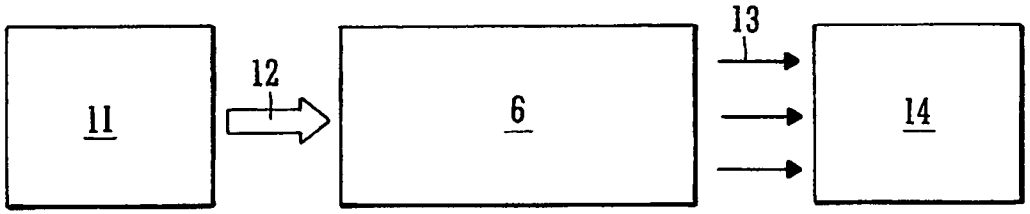
FIG. 5 illustrates an embodiment of the present invention wherein a preferred ion guide or mass filter device is arranged intermediate an ion source and a collision, fragmentation or reaction device and wherein the preferred ion guide or mass filter device is arranged to transmit only certain parent or precursor ions received from the ion source to the collision, fragmentation or reaction device.

The preferred ion guide or mass filter device 6 has a number of different applications. According to one embodiment an ion guide or mass filter device 6 may according to an embodiment of the present invention may be provided or located generally intermediate an ion source 11 and a collision, fragmentation or reaction device 14 as shown in FIG. 5. In a comparable conventional arrangement a conventional quadrupole rod set ion guide might be provided intermediate an ion source and a collision or fragmentation cell. The conventional quadrupole rod set ion guide would transmit substantially all the ions received from the ion source to the collision or fragmentation cell. Disadvantageously, however, many of the species of parent of precursor ions which would be transmitted to the collision or fragmentation cell and which would then be fragmented within the collision or fragmentation cell may not relate to analyte ions of interest.

In contrast, by providing an ion guide or mass filter device 6 according to the preferred embodiment instead of a conventional quadrupole rod set ion guide, a significant improvement in the signal to noise ratio can be achieved by ensuring that only analyte ions of interest are simultaneously transmitted in parallel by the preferred ion guide or mass filter device 6 from the ion source 11 to the collision, fragmentation or reaction device 14. Background ions or ions which are not of interest or which are desired to be excluded can be effectively attenuated by the preferred ion guide or mass filter device 6 and hence prevented from being transmitted to the collision, fragmentation or reaction device 14. The preferred embodiment therefore enables the noise in a total ion chromatogram to be reduced which is particularly advantageous. In one embodiment the preferred ion guide or mass filter device 6 may be used, for example, to transmit in parallel ions having different charge states but which relate to the same species of analyte molecule, atom or compound. For example, doubly and triply charged ions relating to the same species of molecule, atom or compound may be onwardly transmitted whilst all other ions may be substantially attenuated.

Figure 6:
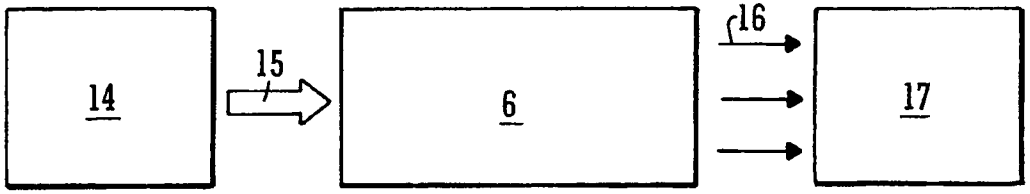
FIG. 6 illustrates another embodiment of the present invention wherein a preferred ion guide or mass filter device is arranged intermediate a collision, fragmentation or reaction device and an ion detector and wherein the preferred ion guide or mass filter device is arranged to transmit only certain daughter, fragment, product or adduct ions received from the collision, fragmentation or reaction device to the ion detector.

According to another embodiment the preferred ion guide or mass filter device 6 may be provided downstream of a collision, fragmentation or reaction device 14 and upstream of an ion detector 17 as shown in FIG. 6. According to this embodiment the preferred ion guide or mass filter device 6 may receive a plurality of different species of daughter, fragment, adduct or product ions 15 and potentially also unfragmented parent or precursor ions. However, the preferred ion guide or mass filter device 6 preferably ensures that only selected daughter, fragment, adduct or product ions of interest 16 which emerge from the collision, fragmentation or reaction device 14 are arranged so as to be onwardly simultaneously transmitted substantially in parallel to the ion detector 17.

A further embodiment of the present invention enables enhanced sensitivity Multiple Reaction Monitoring experiments to be performed. This embodiment will be described in more detail with reference to FIG. 7. In Multiple Reaction Monitoring (MRM) experiments performed using a conventional tandem quadrupole mass spectrometer it is conventional to select a single species of parent or precursor ion using a first quadrupole mass filter which is operated in a high resolution mode of operation. The first quadrupole rod set mass filter selectively transmits a single species of parent or precursor ion and attenuates all other parent or precursor ions. The single species of parent or precursor ion transmitted by the first quadrupole rod set mass filter is then arranged to be fragmented in a collision or fragmentation cell which is arranged downstream of the first quadrupole rod set mass filter. A plurality of different daughter or fragment ions are produced in the collision or fragmentation cell. A second quadrupole rod set mass filter or mass analyser is arranged downstream of the collision or fragmentation cell. The most intense daughter or fragment ions produced in the collision or fragmentation cell are then transmitted and detected by switching and/or scanning the second quadrupole rod set mass filter and detecting the ions using an ion detector.

Figure 7:
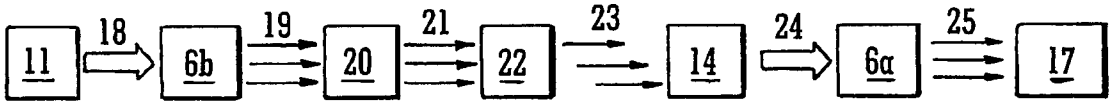
FIG. 7 illustrates an embodiment of the present invention wherein a preferred ion guide or mass filter device is arranged to onwardly transmit certain precursor or parent ions received from an ion source to an ion trap which pulses ions into an ion mobility spectrometer or separator which is arranged upstream of a collision, fragmentation or reaction device, and wherein another preferred ion guide or mass filter device is arranged downstream of the collision, fragmentation or reaction device to transmit only certain daughter, fragment, product or adduct ions received from the collision, fragmentation or reaction device to an ion detector.

According to an embodiment of the present invention a first preferred ion guide or mass filter device 6*a* may be provided downstream of a collision, fragmentation or reaction device 14 as shown in FIG. 7. The first preferred ion guide or mass filter device 6*a* is preferably arranged so as to simultaneously transmit in parallel a plurality of different species of daughter, fragment, adduct or product ions of interest and/or unfragmented parent or precursor ions of interest whilst preferably filtering out or substantially attenuating other daughter, fragment, adduct or product ions and/or unfragmented parent or precursor ions received from the collision, fragmentation or reaction device 14 which are not of interest.

Additionally or alternatively, a second preferred ion guide or mass filter device 6*b* may be provided upstream of an ion accumulation or ion storage device 20 (such as an ion trap) and preferably downstream of an ion source 11. The second preferred ion guide or mass filter device 6*b* is preferably arranged so as to reduce the total ion current entering the ion accumulation or ion storage device 20 by only selectively transmitting species of parent or precursor ions which are known or considered to be of analytical interest. This can also help to reduce space charge effects and capacity effects.

An ion source 11 is preferably arranged to emit a beam of ions 18 which is preferably received by the second preferred ion guide or mass filter device 6*b*. The second preferred ion guide or mass filter device 6*b* preferably selectively transmits certain specific species 19 of parent or precursor ions which are then preferably onwardly transmitted to the downstream ion accumulation region or ion trap 20. After a certain period of time, parent or precursor ions 21 present in the ion accumulation region or ion trap 20 are then preferably ejected out of the ion accumulation region or ion trap 20 and are preferably transported or transmitted to an ion temporal separation region or device 22 which is preferably arranged downstream of the ion accumulation region or ion trap 20. The ion temporal separation region or device 22 is preferably upstream of the collision, fragmentation or reaction device 14.

The ion temporal separation region or device 22 may according to one embodiment comprise an ion mobility spectrometer or separator. The ion mobility spectrometer or separator is preferably arranged to temporally separate ions according to their ion mobility. Ions emerging from the ion mobility spectrometer or separator are then preferably passed or are otherwise onwardly transmitted to the collision, fragmentation or reaction device 14 which is preferably arranged downstream of the ion mobility spectrometer or separator. The ions which emerge over a period of time from the ion mobility spectrometer or separator 22 are preferably fragmented or reacted in sequence in the collision, fragmentation or reaction device 14. Resulting fragment, daughter, adduct or product ions 24 and any unfragmented parent or precursor ions are then preferably transmitted to the first preferred ion guide or mass filter device 6*a* which is preferably arranged downstream of the collision, fragmentation or reaction device 14.

The first preferred ion guide or mass filter device 6*a* preferably only onwardly transmits certain specific or desired fragment, daughter, adduct or product ions 25 or desired unfragmented parent or precursor ions to an ion detector 17 which is preferably arranged downstream of the first preferred ion guide or mass filter device 6*a*. The mass to charge ratio profile or transmission window of the fragment, daughter, adduct or product ions and/or unfragmented parent or precursor ions which are preferably arranged to be onwardly transmitted by the first preferred ion guide or mass filter device 6*a* may or may not be arranged so as to be generally or substantially synchronised with the temporal arrival of specific parent or precursor ions or other ions which preferably emerge from the ion temporal separation region or device 22 and arrive at the entrance to the collision, fragmentation or reaction device 14. The mass to charge ratio profile or transmission window or windows of the fragment, daughter, adduct or product ions and/or unfragmented parent or precursor ions which are transmitted by the first preferred ion guide or mass filter device 6*a* may therefore preferably vary or be scanned with time.

Parent or precursor ions are preferably separated in time as they pass through the temporal separation region or device 22. The temporal separation of the ions may be according to their ion mobility or alternatively it may be according to the mass to charge ratio of the ions.

The ion species which emerge from the temporal separation region or device 22 preferably enter the collision, fragmentation or reaction device 14 at pre-determined times and preferably undergo fragmentation or reaction. The resulting daughter, fragment, adduct or product ions 24 then preferably enter the first preferred ion guide or mass filter device 6*a* wherein a notched broadband signal 10 is preferably applied thereto in use. The first preferred ion guide or mass filter device 6*a* preferably transmits selected daughter, fragment, adduct or product ions 25 and/or unfragmented parent or precursor ions having different mass to charge ratios to an ion detector 17.

The mass to charge ratios of the daughter, fragment, adduct or product ions 25 and/or unfragmented parent or precursor ions which are transmitted by the first preferred ion guide or mass filter device 6*a* may change or vary as a function of time. According to the preferred embodiment the one or more mass to charge ratio transmission windows of the first preferred ion guide or mass filter device 6*a* may vary, for example, according to or depending upon the arrival time of parent or precursor ions at the collision, fragmentation or reaction device 14. In order to maintain temporal separation of daughter, fragment, adduct or product ions resulting from separate or different parent or precursor ions and/or unfragmented parent or precursor ions, the collision, fragmentation or reaction device 14 may preferably use a form of active axial ion transport. The active axial ion transport may comprise generating and translating a plurality of axial potential wells which are preferably created and then preferably translated along the length of the collision, fragmentation or reaction device 14.

During the temporal separation and analysis stages, the ion accumulation region or ion trap 20 upstream of the temporal separation region or device 22 may preferably be filled up again with parent or precursor ions 19 which are preferably selectively onwardly transmitted by the second preferred ion guide or mass filter device 6*b*. Once the previous analysis has finished, these new parent or precursor ions 19 may then be released from the ion accumulation region or ion trap 20 and be passed to the temporal separation region or device 22 for separation and subsequent analysis. The system duty cycle according to this embodiment is preferably relatively high and the daughter, fragment, adduct or product ion signal detected per precursor or parent ion is preferably increased relative to comparable conventional arrangements.

The temporal separation region or device 22 preferably comprises a device which provides a temporal separation of a mixture of ions received from the ion accumulation region or ion trap 20. It is desirable that any daughter, fragment, adduct or product ions 24 emerging from the collision, fragmentation or reaction device 14 or ions emerging from the temporal separation region or device 22 should be able to be temporally correlated or otherwise linked or associated with their corresponding parent or precursor ions. The temporal separation region or device 22 may comprise an ion mobility spectrometer or separator. Alternatively, the temporal separation region or device 22 may comprise a drift region wherein ions are separated according to their mass to charge ratio on the basis of their time of flight through the drift region. According to a yet further embodiment the temporal separation region or device 22 may comprise an ion trap wherein ions are preferably progressively and/or subsequently resonantly ejected from or scanned out of the ion trap.

Active ion propulsion through the collision, fragmentation or reaction device 14 may preferably be utilised in order to prevent the temporal separation of ion species being received into the collision, fragmentation or reaction device 14 from being lost due to multiple collisions between, for example, ions and gas molecules present in the collision, fragmentation or reaction device 14. Ions may be urged through the collision, fragmentation or reaction device 14 by one or more transient DC potentials or voltages or one or more transient DC potentials or voltage waveforms which are preferably applied to the electrodes of the collision, fragmentation or reaction device 14 or by an applied axial voltage or potential gradient.

Embodiments are also contemplated wherein multiple different or separate notched broadband frequency signals may be applied to one or more of the preferred ion guides or mass filter devices 6,6*a*,6*b*. The mass to charge ratio transmission windows created by each separate notched broadband frequency signal may or may not at least partially overlap one another. Furthermore, embodiments are contemplated wherein one or more mass to charge ratio transmission windows may remain substantially constant or fixed with time whereas one or more other mass to charge ratio transmission windows may substantially vary or change with time.

Although the present invention has been described with reference to preferred embodiments, it will be understood by those skilled in the art that various changes in form and detail may be made without departing from the scope of the invention as set forth in the accompanying claims.

The invention claimed is:

1. A method of mass spectrometry conducted with quadrupole excitation applied to a quadrupole rod set ion guide comprising:

generating a broadband quadrupolar excitation;

removing frequency components from said broadband quadrupolar excitation in order to provide a notched broadband quadrupolar excitation having one or more frequency notches;

applying said notched broadband quadrupolar excitation having one or more frequency notches to said quadrupole rod set ion guide; and passing a beam of ions into said quadrupole rod set ion guide and allowing a sub-set of said beam of ions to emerge from said quadrupole rod set ion guide without axially confining ions within said quadrupole rod set.

2. A mass spectrometer comprising:

a quadrupole rod set ion guide;

a voltage source arranged and adapted to generate a broadband quadrupolar excitation and to remove frequency components from said broadband quadrupolar excitation in order to provide a notched broadband quadrupolar excitation having one or more frequency notches;

said voltage source further arranged and adapted to apply said notched broadband quadrupolar excitation to said quadrupole rod set ion guide; and an ion source for passing a beam of ions into said quadrupole rod set ion guide such that in use a sub-set of said beam of ions emerges from said quadrupole rod set ion guide without ions being axially confined within said quadrupole rod set.

3. A mass spectrometer as claimed in claim 2, wherein said voltage source is arranged and adapted to radially eject undesired ions from said ion guide.

4. A mass spectrometer as claimed in claim 2, wherein analyte ions of interest are onwardly transmitted by said ion guide without being substantially confined or trapped axially within said ion guide whereas other ions which are not of analytical interest are substantially attenuated by said ion guide.

5. A mass spectrometer as claimed in claim 2, wherein said ion guide comprises a plurality of electrodes or rods comprising four rods and wherein each rod of said quadrupole rod set has a longitudinal axis and wherein the longitudinal axes of each of said four rods are substantially parallel to or equidistant to one another.

6. A mass spectrometer as claimed in claim 2, wherein said ion guide is arranged to maintain a radial quadratic potential distribution or a radial linear electric field.

7. A mass spectrometer as claimed in claim 2, wherein said voltage source is arranged and adapted to supply a signal having one or more frequency components selected from one of more of the following ranges: (i) <1 kHz; (ii) 1-2 kHz; (iii) 2-3 kHz; (iv) 3-4 kHz; (v) 4-5 kHz; (vi) 5-6 kHz; (vii) 6-7 kHz; (viii) 7-8kHz; (ix) 8-9 kHz; (x) 9-10 kHz; (xi) 10-11 kHz; (xii) 11-12 kHz; (xiii) 12-13 kHz; (xiv) 13-14 kHz; (xv) 14-15 kHz; (xvi) 15-16 kHz; (xvii) 16-17 kHz; (xviii) 17-18 kHz; (xix) 18-19 kHz; (xx) 19-20 kHz; (xxi) 20-21 kHz; (xxii) 21-22 kHz; (xxiii) 22-23 kHz; (xxiv) 23-24 kHz; (xxv) 24-25 kHz; (xxvi) 25-26 kHz; (xxvii) 26-27 kHz; (xxviii) 27-28 kHz; (xxix) 28-29 kHz; (xxx) 29-30 kHz; and (xxxi) >30 kHz.

8. A mass spectrometer as claimed in claim 2, wherein said excitation comprises at least 1, 2, 3, 4, 5, 6, 7, 8, 9, 10, 11, 12, 13, 14, 15, 16, 17, 18, 19or 20 frequency notches.

9. A mass spectrometer as claimed in claim 2, wherein said one or more frequency notches correspond with secular, resonance, first or fundamental harmonic frequencies of one or more ions which are desired to be onwardly transmitted by said ion guide.

10. A mass spectrometer as claimed in claim 2, wherein said one or more frequency notches correspond with secular, resonance or first, fundamental harmonic frequencies of at least 1, 2, 3, 4, 5, 6, 7, 8, 9, 10, 11, 12, 13, 14, 15, 16, 17, 18, 19 or 20 different species of analyte ion of interest.

11. A mass spectrometer as claimed in claim 2, wherein said voltage source is arranged and adapted to supply a signal to a plurality of electrodes or rods of said ion guide which does not substantially cause analyte ions of interest to be resonantly excited or radially ejected from said ion guide.

12. A mass spectrometer as claimed in claim 2, wherein at frequencies corresponding to said one or more frequency notches ions within said ion guide are not substantially resonantly excited or are resonantly excited but are not sufficiently resonantly excited such that ions are caused to be radially ejected from said ion guide.

13. A mass spectrometer as claimed in claim 2, wherein said voltage source is arranged and adapted to cause said ion guide to have one or a plurality of discrete or separate simultaneous mass to charge ratio transmission windows such that an ion having a mass to charge ratio falling within a mass to charge ratio transmission window will be onwardly transmitted by said ion guide or such that an ion having a mass to charge ratio falling outside of a mass to charge ratio transmission window will be substantially attenuated by or resonantly ejected from said ion guide.

14. A mass spectrometer as claimed in claim 13, wherein said voltage source is arranged and adapted to cause said ion guide to have at least 1, 2, 3, 4, 5, 6, 7, 8, 9, 10, 11, 12, 13, 14, 15, 16, 17, 18, 19 or 20 discrete or separate simultaneous mass to charge ratio transmission windows.

15. A mass spectrometer as claimed in claim 14, wherein said discrete or separate simultaneous mass to charge ratio transmission windows are substantially non-overlapping or non-continuous.

16. A mass spectrometer as claimed in claim 13, wherein the centre or width of one or more of said mass to charge ratio transmission windows remains substantially constant with time or over a time period selected from the group consisting of: (i) 0-1 ms; (ii) 1-2 ms; (iii) 2-3 ms; (iv) 3-4 ms; (v) 4-5 ms; (vi) 5-6 ms; (vii) 6-7 ms; (viii) 7-8 ms; (ix) 8-9 ms; (x) 9-10 ms; (xi) 10-11 ms; (xii) 11-12 ms; (xiii) 12-13 ms; (xiv) 13-14 ms; (xv) 14-15 ms; (xvi) 15-16 ms; (xvii) 16-17 ms; (xviii) 17-18 ms; (xix) 18-19 ms; (xx) 19-20 ms; (xxi) 20-21 ms; (xxii) 21-22 ms; (xxiii) 22-23 ms; (xxiv) 23-24 ms; (xxv) 24-25 ms; (xxvi) 25-26 ms; (xxvii) 26-27 ms; (xxviii) 27-28 ms; (xxix) 28-29 ms; (xxx) 29-30 ms; and (xxxi) >30 ms.

17. A mass spectrometer as claimed in claim 13, wherein the centre or width of one or more of said mass to charge ratio transmission windows substantially varies or increases or decreases with time or over a time period selected from the group consisting of: (i) 0-1 ms; (ii) 1-2 ms; (iii) 2-3 ms; (iv) 3-4 ms; (v) 4-5 ms; (vi) 5-6 ms; (vii) 6-7 ms; (viii) 7-8 ms; (ix) 8-9ms; (x) 9-10 ms; (xi) 10-11 ms; (xii) 11-12 ms; (xiii) 12-13 ms; (xiv) 13-14 ms; (xv) 14-15 ms; (xvi) 15-16 ms; (xvii) 16-17 ms; (xviii) 17-18 ms; (xix) 18-19 ms; (xx) 19-20 ms; (xxi) 20-21 ms; (xxii) 21-22 ms; (xxiii) 22-23 ms; (xxiv) 23-24 ms; (xxv) 24-25 ms; (xxvi) 25-26 ms; (xxvii) 26-27 ms; (xxviii) 27-28 ms; (xxix) 28-29 ms; (xxx) 29-30 ms; and (xxxi) >30 ms.

18. A mass spectrometer as claimed in claim 17, wherein the centre or width of the one or more mass to charge ratio transmission windows may vary in a substantially progressive, non-progressive, linear, non-linear, quadratic, smooth, stepped, regular, random or quasi-random manner.

19. A mass spectrometer as claimed in claim 2, wherein said ion guide has an ion entrance region and an ion exit region and wherein in a mode of operation x % of the ions received by said ion guide at said ion entrance region are transmitted to said ion exit region, wherein x is selected from the group consisting of: (i) <1; (ii) 1-5; (iii) 5-10; (iv) 10-15; (v) 15-20; (vi) 20-25; (vii) 25-30; (viii) 30-35; (ix) 35-40; (x) 40-45; (xi) 45-50; (xii) 50-55; (xiii) 55-60; (xiv) 60-65; (xy) 65-70; (xvi) 70-75; (xvii) 75-80; (xviii) 80-85; (xix) 85-90; (xx) 90-95; (xxi) 95-99.99; and (xxii) <100.

20. A mass spectrometer as claimed in claim 2, wherein said ion guide has an ion entrance region and an ion exit region and wherein in a mode of operation y % of the ions received by said ion guide at said ion entrance region are attenuated or radially ejected from said ion guide before reaching said ion exit region, wherein y is selected from the group consisting of: (i) <1; (ii) 1-5; (iii) 5-10; (iv) 10-15; (v) 15-20; (vi) 20-25; (vii) 25-30; (viii) 30-35; (ix) 35-40; (x) 40-45; (xi) 45-50; (xii) 50-55; (xiii) 55-60; (xiv) 60-65; (xv) 65-70; (xvi) 70-75; (xvii) 75-80; (xviii) 80-85; (xix) 85-90; (xx) 90-95; (xxi) 95-99.99; and (xxii) <100.

21. A mass spectrometer as claimed in claim 2, wherein said ion guide is arranged and adapted to simultaneously transmit a plurality of different desired ions having a non-continuous range of mass to charge ratios.

22. A mass spectrometer as claimed in claim 2, further comprising an AC or RF voltage supply for supplying an AC or RF voltage to a plurality of electrodes or rods of said quadrupole rod set ion guide.

23. A mass spectrometer as claimed in claim 22, wherein said AC or RF voltage supply is arranged and adapted to supply an AC or RF voltage to said plurality of electrodes or rods having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-1000 V peak to peak; (xii) 1-2 kV peak to peak; (xiii) 2-3 kV peak to peak; (xiv) 3-4 kV peak to peak; (xv) 4-5 kV peak to peak; (xvi) 5-6 kV peak to peak; (xvii) 6-7 kV peak to peak; (xviii) 7-8 kV peak to peak; (xix) 8-9 kV peak to peak; (xx) 9-10 kV peak to peak; and (xxi) >10 kV peak to peak.

24. A mass spectrometer as claimed in claim 22, wherein said AC or RF voltage supply is arranged and adapted to supply an AC or RF voltage to said plurality of electrodes or rods having a frequency selected from the group consisting of: (i) <100 kHz; (ii) 100-200 kHz; (iii) 200-300 kHz; (iv) 300-400 kHz; (v) 400-500kHz; (vi) 0.5-1.0 MHz; (vii) 1.0-

1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

25. A mass spectrometer as claimed in claim 2, wherein in a first mode of operation substantially all of a plurality of electrodes or rods of said ion guide are maintained at substantially the same DC potential or voltage.

26. A mass spectrometer as claimed in claim 2, wherein in a first mode of operation said ion guide is operated in a substantially non-resolving or ion guiding mode of operation.

27. A mass spectrometer as claimed in claim 2, wherein in a second mode of operation adjacent electrodes or rods of said ion guide are maintained at substantially different DC potentials or voltages.

28. Amass spectrometer as claimed in claim 27, wherein in said second mode of operation a DC potential or voltage difference is maintained between adjacent electrodes or rods, wherein said DC potential or voltage difference is selected from the group consisting of: (i) <1 V; (ii) 1-2 V; (iii) 2-3 V; (iv) 3-4 V; (v) 4-5V; (vi) 5-6 V; (vii) 6-7 V; (viii) 7-8 V; (ix) 8-9V; (x) 9-10 V; (xi) 10-20 V; (xii) 20-30V; (xiii) 30-40 V; (xiv) 40-50 V; (xv) 50-60 V; (xvi) 60-70 V; (xvii) 70-80 V; (xviii) 80-90 V; (xix) 90-100 V; and (xx) >100 V.

29. A mass spectrometer as claimed in claim 27, wherein in said second mode of operation opposed electrodes or rods of said ion guide are maintained at substantially the same DC potential or voltage.

30. A mass spectrometer as claimed in claim 27, wherein in a mode of operation said ion guide is operated in a resolving or mass filtering mode of operation.

31. A mass spectrometer as claimed in claim 2, wherein in a mode of operation said ion guide has one or more mass to charge ratio transmission windows, one or more of said mass to charge ratio transmission windows having a width of z mass units, wherein z falls within a range selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-15; (xii) 15-20; (xiii) 20-25; (xiv) 25-30; (xv) 30-35; (xvi) 35-40; (xvii) 40-45; (xviii) 45-50; (xix) 50-60; (xx) 60-70; (xxi) 70-80; (xxii) 80-90; (xxiii) 90-100; (xxiv) 100-120; (xxv) 120-140; (xxvi) 140-160; (xxvii) 160-180; (xxviii) 180-200; (xxix) 200-250; (xxx) 250-300; (xxxi) 300-350; (xxxii) 350-400; (xxxiii) 400-450; (xxxiv) 450-500; and (xxxv) >500.

32. A mass spectrometer as claimed in claim 2, wherein in a mode of operation a combination of DC or AC or RF voltages are applied to a plurality of electrodes or rods of said ion guide such that said ion guide is arranged to operate as a low pass mass filter.

33. A mass spectrometer as claimed in claim 32, wherein when said ion guide is arranged to operate as a low pass mass filter ions having a mass to charge ratio greater than a high mass to charge ratio cut-off value are substantially attenuated by said ion guide, and wherein said high mass to charge ratio cut-off value is selected from the group consisting of: (i) <100; (ii) 100-200; (iii) 200-300; (iv) 300-400; (v) 400-500; (vi) 500-600; (vii) 600-700; (viii) 700-800; (ix) 800-900; (x) 900-1000; (xi) 1000-1100; (xii) 1100-1200; (xiii) 1200-1300; (xiv) 1300-1400; (xv) 1400-1500; (xvi) 1500-1600; (xvii) 1600-1700; (xviii) 1700-1800; (xix) 1800-1900; (xx) 1900-2000; and (xxi) >2000.

34. A mass spectrometer as claimed in claim 2, wherein in a mode of operation a combination of DC or AC or RF voltages are applied to a plurality of electrodes or rods of said ion guide such that said ion guide is arranged to operate as a band pass mass filter.

35. A mass spectrometer as claimed in claim 34, wherein when said ion guide is arranged to operate as a band pass mass filter ions having a mass to charge ratio greater than a high mass to charge ratio cut-off value are substantially attenuated by said ion guide, and wherein said high mass to charge ratio cut-off value is selected from the group consisting of: (i) <100; (ii) 100-200; (iii) 200-300; (iv) 300-400; (v) 400-500; (vi) 500-600; (vii) 600-700; (viii) 700-800; (ix) 800-900; (x) 900-1000; (xi) 1000-1100; (xii) 1100-1200; (xiii) 1200-1300; (xiv) 1300-1400; (xv) 1400-1500; (xvi) 1500-1600; (xvii) 1600-1700; (xviii) 1700-1800; (xix) 1800-1900; (xx) 1900-2000; and (xxi) >2000.

36. A mass spectrometer as claimed in claim 34, wherein when said ion guide is arranged to operate as a band pass mass filter ions having a mass to charge ratio lower than a low mass to charge ratio cut-off value are substantially attenuated by said ion guide, and wherein said low mass to charge ratio cut-off value is selected from the group consisting of: (i) <100; (ii) 100-200; (iii) 200-300; (iv) 300-400; (v) 400-500; (vi) 500-600; (vii) 600-700; (viii) 700-800; (ix) 800-900; (x) 900-1000; (xi) 1000-1100; (xii) 1100-1200; (xiii) 1200-1300; (xiv) 1300-1400; (xv) 1400-1500; (xvi) 1500-1600; (xvii) 1600-1700; (xviii) 1700-1800; (xix) 1800-1900; (xx) 1900-2000; and (xxi) >2000.

37. A mass spectrometer as claimed in claim 2, wherein in a mode of operation a combination of DC or AC or RF voltages are applied to a plurality of electrodes or rods of said ion guide such that said ion guide is arranged to operate as a high pass mass filter.

38. A mass spectrometer as claimed in claim 37, wherein when said ion guide is arranged to operate as a high pass mass filter ions having a mass to charge ratio lower than a low mass to charge ratio cut-off value are substantially attenuated by said ion guide, and wherein said low mass to charge ratio cut-off value is selected from the group consisting of: (i) <100; (ii) 100-200; (iii) 200-300; (iv) 300-400; (v) 400-500; (vi) 500-600; (vii) 600-700; (viii) 700-800; (ix) 800-900; (x) 900-1000; (xi) 1000-1100; (xii) 1100-1200; (xiii) 1200-1300; (xiv) 1300-1400; (xv) 1400-1500; (xvi) 1500-1600; (xvii) 1600-1700; (xviii) 1700-1800; (xix) 1800-1900; (xx) 1900-2000; and (xxi) >2000.

39. A mass spectrometer as claimed in claim 2, further comprising a collision, fragmentation or reaction device arranged upstream or downstream of said ion guide.

40. A mass spectrometer as claimed in claim 39, wherein said collision, fragmentation or reaction device comprises: (i) a multipole rod set or a segmented multipole rod set wherein said multipole rod set comprises a quadrupole rod set, a hexapole rod set, an octapole rod set or a rod set comprising more than eight rods; (ii) an ion tunnel or ion funnel wherein said ion tunnel or ion funnel comprises a plurality of electrodes or at least 2, 5, 10, 20, 30, 40, 50, 60, 70, 80, 90 or 100 electrodes having apertures through which ions are transmitted in use and wherein at least 5%, 10%, 15%, 20%, 25%, 30%, 35%, 40%, 45%, 50%, 55%, 60%, 65%, 70%, 75%, 80%, 85%, 90%, 95% or 100% of said electrodes have apertures which are of substantially the same size or area or which have apertures which become progressively larger or smaller in size or in area; or (iii) a stack or array of planar, plate or mesh electrodes wherein said stack or array of planar, plate or mesh electrodes comprises a plurality or at least 2, 3, 4, 5, 6, 7, 8, 9, 10, 11, 12, 13, 14, 15, 16, 17, 18, 19 or 20 planar, plate or mesh electrodes, wherein at least 5%, 10%, 15%, 20%, 25%, 30%, 35%, 40%, 45%, 50%, 55%, 60%, 65%, 70%, 75%, 80%, 85%, 90%, 95% or 100% of said planar, plate or mesh electrodes are arranged generally in the plane in which ions travel in use, and wherein said mass spectrometer further comprises AC or RF voltage means for supplying said plurality of planar, plate or mesh electrodes with an AC or RF voltage and wherein adjacent planar, plate or mesh electrodes are supplied with opposite phases of said AC or RF voltage.

41. A mass spectrometer as claimed in claim 39, wherein said collision, fragmentation or reaction device is arranged to fragment ions by Collisional Induced Dissociation ("CID") or wherein said collision, fragmentation or reaction device is selected from the group consisting of: (i) a Surface Induced Dissociation ("SID") fragmentation device; (ii) an Electron Transfer Dissociation fragmentation device; (iii) an Electron Capture Dissociation fragmentation device; (iv) an Electron Collision or Impact Dissociation fragmentation device; (v) a Photo Induced Dissociation ("PID") fragmentation device; (vi) a Laser Induced Dissociation fragmentation device; (vii) an infrared radiation induced dissociation device; (viii) an ultraviolet radiation induced dissociation device; (ix) a nozzle-skimmer interface fragmentation device; (x) an in-source fragmentation device; (xi) an ion-source Collision Induced Dissociation fragmentation device; (xii) a thermal or temperature source fragmentation device; (xiii) an electric field induced fragmentation device; (xiv) a magnetic field induced fragmentation device; (xv) an enzyme digestion or enzyme degradation fragmentation device; (xvi) an ion-ion reaction fragmentation device; (xvii) an ion-molecule reaction fragmentation device; (xviii) an ion-atom reaction fragmentation device; (xix) an ion-metastable ion reaction fragmentation device; (xx) an ion-metastable molecule reaction fragmentation device; (xxi) an ion-metastable atom reaction fragmentation device; (xxii) an ion-ion reaction device for reacting ions to form adduct or product ions; (xxiii) an ion-molecule reaction device for reacting ions to form adduct or product ions; (xxiv) an ion-atom reaction device for reacting ions to form adduct or product ions; (xxv) an ion-metastable ion reaction device for reacting ions to form adduct or product ions; (xxvi) an ion-metastable molecule reaction device for reacting ions to form adduct or product ions; and (xxvii) an ion-metastable atom reaction device for reacting ions to form adduct or product ions.

42. A mass spectrometer as claimed in claim 2, further comprising an ion mobility spectrometer or separator arranged upstream or downstream of said ion guide.

43. A mass spectrometer as claimed in claim 42, wherein said ion mobility spectrometer or separator comprises a gas phase electrophoresis device.

44. A mass spectrometer as claimed in claim 42, wherein said ion mobility spectrometer or separator comprises: (i) a drift tube wherein said drift tube comprises one or more electrodes and means for maintaining an axial DC voltage gradient or a substantially constant or linear axial DC voltage gradient along at least 5%, 10%, 15%, 20%, 25%, 30%, 35%, 40%, 45%, 50%, 55%, 60%, 65%, 70%, 75%, 80%, 85%, 90%, 95% or 100% of the axial length of said drift tube; (ii) a multipole rod set or a segmented multipole rod set wherein said multipole rod set comprises a quadrupole rod set, a hexapole rod set, an octapole rod set or a rod set comprising more than eight rods; (iii) an ion tunnel or ion funnel wherein said ion tunnel or ion tunnel comprises a plurality of electrodes or at least 2, 5, 10, 20, 30, 40, 50, 60, 70, 80, 90 or 100 electrodes having apertures through which ions are transmitted in use and wherein at least 5%, 10%, 15%, 20%, 25%, 30%, 35%, 40%, 45%, 50%, 55%, 60%, 65%, 70%, 75%, 80%, 85%, 90%, 95% or 100% of said electrodes have apertures which are of substantially the same size or area or which have apertures which become progressively larger or smaller in size or in area; or (iv) a stack or array of planar, plate or mesh electrodes wherein said stack or array of planar, plate or mesh electrodes comprises a plurality or at least 2, 3, 4, 5, 6, 7, 8, 9, 10, 11, 12, 13, 14, 15, 16, 17, 18, 19 or 20 planar, plate or mesh electrodes arranged generally in the plane in which ions travel in use wherein at least some or at least 5%, 10%, 15%, 20%, 25%, 30%, 35%, 40%, 45%, 50%, 55%, 60%, 65%, 70%, 75%, 80%, 85%, 90%, 95% or 100% of said planar, plate or mesh electrodes are supplied with an AC or RF voltage and wherein adjacent planar, late or, mesh electrodes are supplied with opposite phases of said AC or RF voltage.

45. A mass spectrometer as claimed in claim 2, further comprising a drift region, drift tube or field free region arranged upstream or downstream of said ion guide.

46. A mass spectrometer as claimed in claim 2, further comprising an ion trap or ion trapping region arranged upstream or downstream of said ion guide.

47. A mass spectrometer as claimed in claim 46, wherein ions are arranged in a mode of operation to be mass selectively or resonantly ejected from said ion trap or ion trapping region or wherein ions are arranged in a mode of operation to be non-mass selectively or resonantly ejected from said ion trap or ion trapping region.

48. A mass spectrometer as claimed in claim 46, wherein said ion trap comprises: (i) a quadrupole ion trap; (ii) a 2D or linear quadrupole ion trap; or (iii) a Paul or 3D quadrupole ion trap.

49. A mass spectrometer as claimed in claim 2, further comprising an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63radioactive ion source; (xvii) an Atmospheric Pressure Matrix Assisted Laser Desorption Ionisation ion source; and (xviii) a Thermospray ion source.

50. A mass spectrometer as claimed in claim 49, wherein said ion source comprises a pulsed or continuous ion source.

51. A mass spectrometer as claimed in claim 49, further comprising a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; and (xi) a Fourier Transform mass analyser.

52. A mass spectrometer as claimed in claim 22, wherein said AC or RF voltage supply comprises a two phase supply and wherein opposite phases of said AC or RF voltage are arranged to be applied to adjacent electrodes or rods.

53. The method of claim 1, further comprising:

radially ejecting undesired ions from said ion guide.

54. The method of claim 1, further comprising:

onwardly transmitting analyte ions of interest without substantially confining or trapping the analyte ions of interest axially; and substantially attenuating other ions that are not of analytical interest.

55. The method of claim 1, further comprising:

onwardly transmitting ions have a mass to charge ratio falling within a mass to charge transmission window; and substantially attenuating or resonantly ejecting ions having a mass to charge ratio falling outside of the mass to charge ratio transmission window.

56. The method of claim 1, further comprising:

simultaneously transmitting a plurality of different desired ions having a non-continuous range of mass to charge ratios.

57. The method of claim 1, further comprising:

applying a combination of DC or AC or RF voltages such that said ion guide is arranged to operate as a low pass mass filter, a band pass mass filter or a high pass mass filter.

* * * * *